US010167841B2

(12) United States Patent
Nakamura et al.

(10) Patent No.: US 10,167,841 B2
(45) Date of Patent: Jan. 1, 2019

(54) INTERNAL-COMBUSTION-ENGINE COMBUSTION STATE DETECTING APPARATUS

(71) Applicant: Mitsubishi Electric Corporation, Tokyo (JP)

(72) Inventors: Toshifumi Nakamura, Tokyo (JP); Takahiko Inada, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/590,130

(22) Filed: May 9, 2017

(65) Prior Publication Data

US 2018/0230960 A1 Aug. 16, 2018

(30) Foreign Application Priority Data

Feb. 14, 2017 (JP) ..... 2017-024606

(51) Int. Cl.

| | |
|---|---|
| ***F02P 11/02*** | (2006.01) |
| ***F02P 17/02*** | (2006.01) |
| ***F02P 17/00*** | (2006.01) |
| *F02P 17/12* | (2006.01) |

(52) U.S. Cl.

CPC ..... *F02P 17/02* (2013.01); *F02P 17/00* (2013.01); *F02P 2017/125* (2013.01)

(58) Field of Classification Search

CPC ..... F02P 1/08; F02P 1/083; F02P 9/00; F02P 9/002; F02P 11/06; F02P 17/00; F02P 17/02; F02P 17/12; H01T 13/02

USPC ... 123/406.14, 619–622, 634, 642, 651–656; 701/105

See application file for complete search history.

(56) References Cited

U.S. PATENT DOCUMENTS

| | | | | |
|---|---|---|---|---|
| 4,479,467 | A * | 10/1984 | Burrows | F02P 15/10 123/606 |
| 6,526,953 | B1 | 3/2003 | Inagaki | |
| 7,401,603 | B1 * | 7/2008 | Lepley | F02P 3/0846 123/598 |
| 8,893,692 | B2 * | 11/2014 | Brandes | F02P 3/053 123/644 |

(Continued)

FOREIGN PATENT DOCUMENTS

| | | |
|---|---|---|
| JP | 2001-012338 A | 1/2001 |
| JP | 2006-077762 A | 3/2006 |

(Continued)

OTHER PUBLICATIONS

Communication dated Nov. 14, 2017 from the Japanese Patent Office in counterpart Japanese application No. 2017-024606.

*Primary Examiner* — John Kwon
*Assistant Examiner* — Johnny H Hoang
(74) *Attorney, Agent, or Firm* — Sughrue Mion, PLLC; Richard C. Turner

(57) ABSTRACT

An internal-combustion-engine combustion state detecting apparatus is configured in such a way as to include a circulation unit that short-circuits a primary winding so as to form a circulation path including the primary winding, while a spark discharge is produced in an ignition plug, and a circulation current control unit that controls a circulation current flowing in the circulation path and in such a way that based on an ion current detected by an ion current detection apparatus, the combustion state of an inflammable fuel-air mixture is detected.

6 Claims, 15 Drawing Sheets

(56) References Cited

U.S. PATENT DOCUMENTS

| | | | | |
|---|---|---|---|---|
| 2013/0076362 | A1* | 3/2013 | Steinrueck | F02P 17/12<br>324/382 |
| 2014/0137846 | A1* | 5/2014 | Lenz | F02P 1/086<br>123/644 |
| 2015/0122239 | A1* | 5/2015 | Tojo | F02P 3/0453<br>123/609 |
| 2016/0160832 | A1* | 6/2016 | Skinner | F02P 3/0442<br>315/219 |

FOREIGN PATENT DOCUMENTS

| | | | |
|---|---|---|---|
| JP | 2007-032352 | A | 2/2007 |
| JP | 2009-275625 | A | 11/2009 |

* cited by examiner

INTERNAL-COMBUSTION-ENGINE COMBUSTION STATE DETECTING APPARATUS

BACKGROUND OF THE INVENTION

Field of the Invention

The present invention relates to an internal-combustion-engine combustion state detecting apparatus and particularly to an internal-combustion-engine combustion state detecting apparatus that can accurately detect whether or not there exists combustion in a wide operation region of an internal combustion engine.

Description of the Related Art

In the operation of an internal combustion engine, molecules of mixed gas in a combustion chamber of the internal combustion engine are ionized as the mixed gas in the combustion chamber combusts; then, when a voltage is applied through an ignition plug to the inside of the combustion engine where the molecules have been ionized, a minute electric current is generated and flows therein. This minute electric current is referred to as an ion current. To date, the following method has been known: in an spark-ignition internal combustion engine, an ion current to be generated in an combustion chamber after ignition utilizing an ignition plug is detected; based on the magnitude of the detected ion current, the time in which the ion current is being generated, and the like, the operation state of the internal combustion engine, such as knocking, preignition, or a combustion limit, is detected; then, based on the detection result, the ignition timing is adjusted or the fuel injection amount is corrected (for example, refer to Patent Document 1).

However, in the case where as described above, an ignition plug is utilized as an ion current detection probe, detection of the combustion state by use of an ion current cannot be performed during a period of spark discharging through the ignition plug of an ignition apparatus, due to the electric current generated by the spark discharging. Moreover, in the case where the speed of combustion inside a cylinder is high because for example, the operation condition of the internal combustion engine is high-speed-rotation and high-load, the period from a time when ignition is started to a time when generation of ions produced through combustion ends becomes short; thus, as disclosed also in Patent Document 2, in the case where the speed of combustion inside a cylinder is high, most of the generation period of ions produced through combustion is embedded in the spark discharging period; as a result, there has been a problem that detection of the combustion state based on ion current information is difficult.

In this case, it is recommended that in order to adjust and shorten the spark discharging time in accordance with the operation condition, the spark discharge by a current-cutoff ignition apparatus is forcibly interrupted in process of discharging, by short-circuiting the primary winding of the current-cutoff ignition apparatus. To date, there has been proposed a discharge stopping apparatus that interrupts discharging in process of spark discharging by a current-cutoff ignition apparatus (for example, refer to Patent Document 3). When in such a way as described above, the spark discharging time is adjusted so as to become short in accordance with the operation condition, the ion current that is embedded in a spark discharge in normal ignition can be detected.

PRIOR ART REFERENCE

Patent Document

[Patent Document 1] Japanese Patent Application Laid-Open No. 2009-275625

[Patent Document 2] Japanese Patent Application Laid-Open No. 2006-77762

[Patent Document 3] Japanese Patent Application Laid-Open No. 2001-12338

As described above, to date, there has been proposed a discharge stopping apparatus that interrupts discharge in process of spark discharge by a current-cutoff ignition apparatus; in an ignition apparatus disclosed in Patent Document 3, a thyristor for controlling ignition energy is connected in parallel with the primary winding of an ignition winding so that when ignition operation is performed, the voltage induced across the primary winding of the ignition winding is applied in the forward direction between the anode and the cathode of the thyristor; after at an ignition timing, the primary current of the ignition winding is interrupted, the foregoing thyristor is turned on at an appropriate timing and hence the primary winding of the ignition winding is short-circuited, so that the ignition output is attenuated and hence the spark discharge is stopped.

In such a conventional discharge stopping apparatus as described above, an electric current is made to flow in the primary winding of an ignition winding and hence the magnetic field corresponding to the magnetic flux left in the iron core of the ignition winding is generated so that discharging is stopped, and then, the electric current in the primary winding is gradually decreased, so that without causing discharging to occur again, the discharge stopping process is completed before the next ignition cycle of the internal combustion engine starts; however, in the case where the internal combustion engine is under a high-rotation-speed operation condition where the ignition period is short, it is required to quickly decrease the electric current flowing in the primary winding in order to complete the discharge stopping process. However, when the electric current flowing in the primary winding is quickly decreased, a voltage having a polarity the same as that of the ignition high voltage is generated across the secondary winding and is applied to the ignition plug. The voltage in this situation is approximately several hundred [V] and is under the discharge maintaining voltage; however, this voltage is applied to the ignition plug while the discharging is interrupted.

However, the voltage that is generated while discharging is interrupted and has a polarity the same as that of the ignition high voltage adversely affect the detection of the ion current by an ion current detection apparatus; thus, in some cases, the ion-current detection performance of the ion current detection apparatus is deteriorated or the ion current cannot be detected. Accordingly, there has been a problem that it is difficult to simply apply an ion current detection apparatus to an ignition apparatus provided with such a discharge stopping apparatus as described above.

The present invention has been implemented in order to solve the foregoing problems in conventional apparatuses; the objective thereof is to provide an internal-combustion-engine combustion state detecting apparatus that can accurately comprehend the combustion state, based on detection of an ion current, in a wide operation region of an internal combustion engine.

SUMMARY OF THE INVENTION

An internal-combustion-engine combustion state detecting apparatus according to the present invention is configured in such a way as to detect the combustion state of an inflammable fuel-air mixture, based on an ion current detected by an ion current detection apparatus; the internal-combustion-engine combustion state detecting apparatus includes an ignition plug that is provided with a first electrode and a second electrode facing each other through a gap and produces a spark discharge in the gap so that an inflammable fuel-air mixture inside a combustion chamber of an internal combustion engine is combusted, an ignition winding including a primary winding and a secondary winding magnetically coupled with the primary winding, a power source apparatus that supplies the primary winding with an electric current, a switch that is disposed between the primary winding and the power source apparatus and controls energization and de-energization of the electric current, and an ion current detection apparatus that detects, as an ion current, an ion that is produced in the combustion chamber, due to combustion of the inflammable fuel-air mixture; the ignition winding is configured in such a way that when the switch is in a conduction state, the power source apparatus supplies the primary winding with an electric current and hence there is accumulated energy for producing a spark discharge in the ignition plug and in such a way that when the switch is turned off while the energy is accumulated, the electric current is interrupted and hence the spark discharge occurs in the gap of the secondary winding; the internal-combustion-engine combustion state detecting apparatus is characterized by including a circulation unit that is configured in such a way that while the spark discharge is produced in the ignition plug, the primary winding is short-circuited so that a circulation path including the primary winding is formed and a circulation current control unit that is configured in such a way as to control a circulation current flowing in the circulation path.

A combustion state detecting apparatus according to the present invention includes a circulation unit that is configured in such a way that while a spark discharge is produced in an ignition plug, a primary winding is short-circuited so that a circulation path including the primary winding is formed and a circulation current control unit that is configured in such a way as to control a circulation current flowing in the circulation path; thus, the spark discharge is interrupted by the circulation unit and during the interruption of the spark discharge, the circulation current control unit controls the circulation current in such a way that the changing amount of the value of the electric current flowing in the primary winding is decreased or the current value becomes substantially constant, so that comprehension of the combustion state, based on the detection of an ion current, can accurately be performed in a wide operation region of an internal combustion engine.

The foregoing and other object, features, aspects, and advantages of the present invention will become more apparent from the following detailed description of the present invention when taken in conjunction with the accompanying drawings.

Figure 5A:
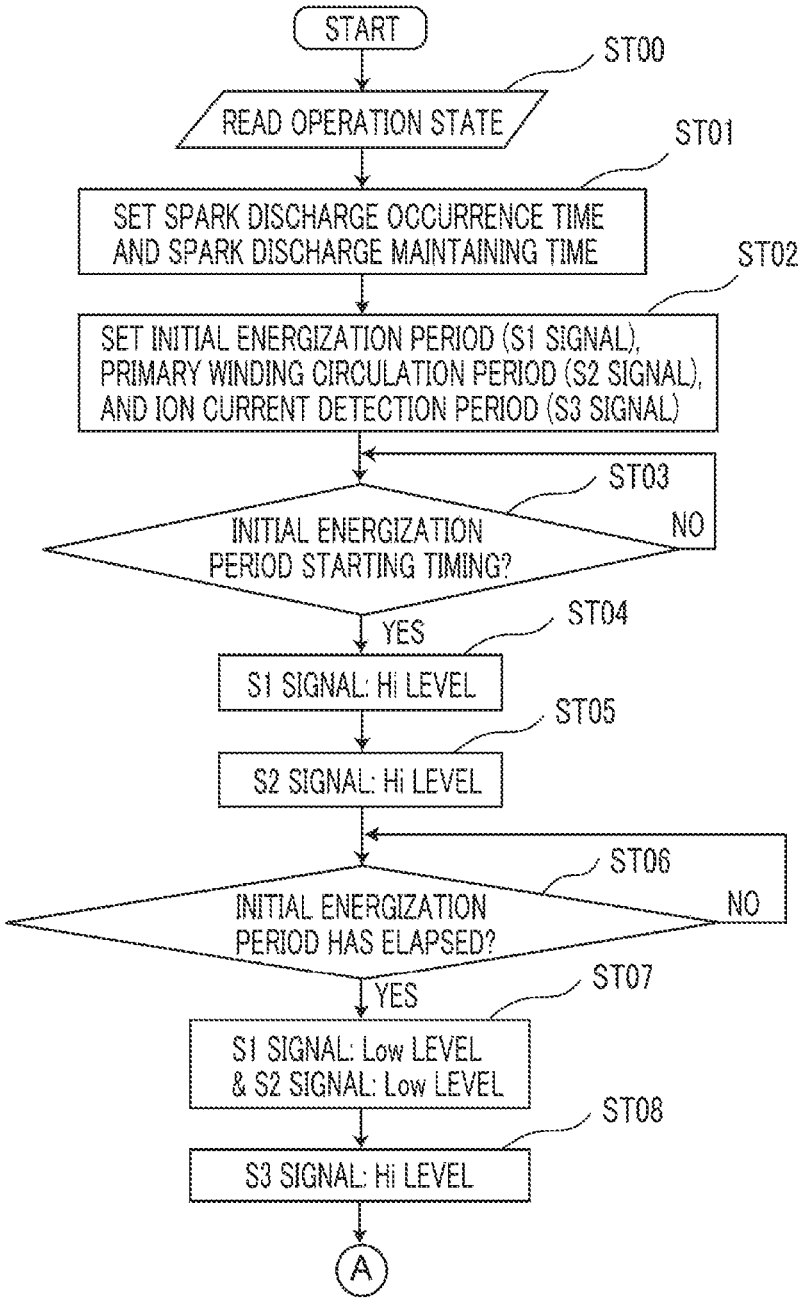
Figure 5B:
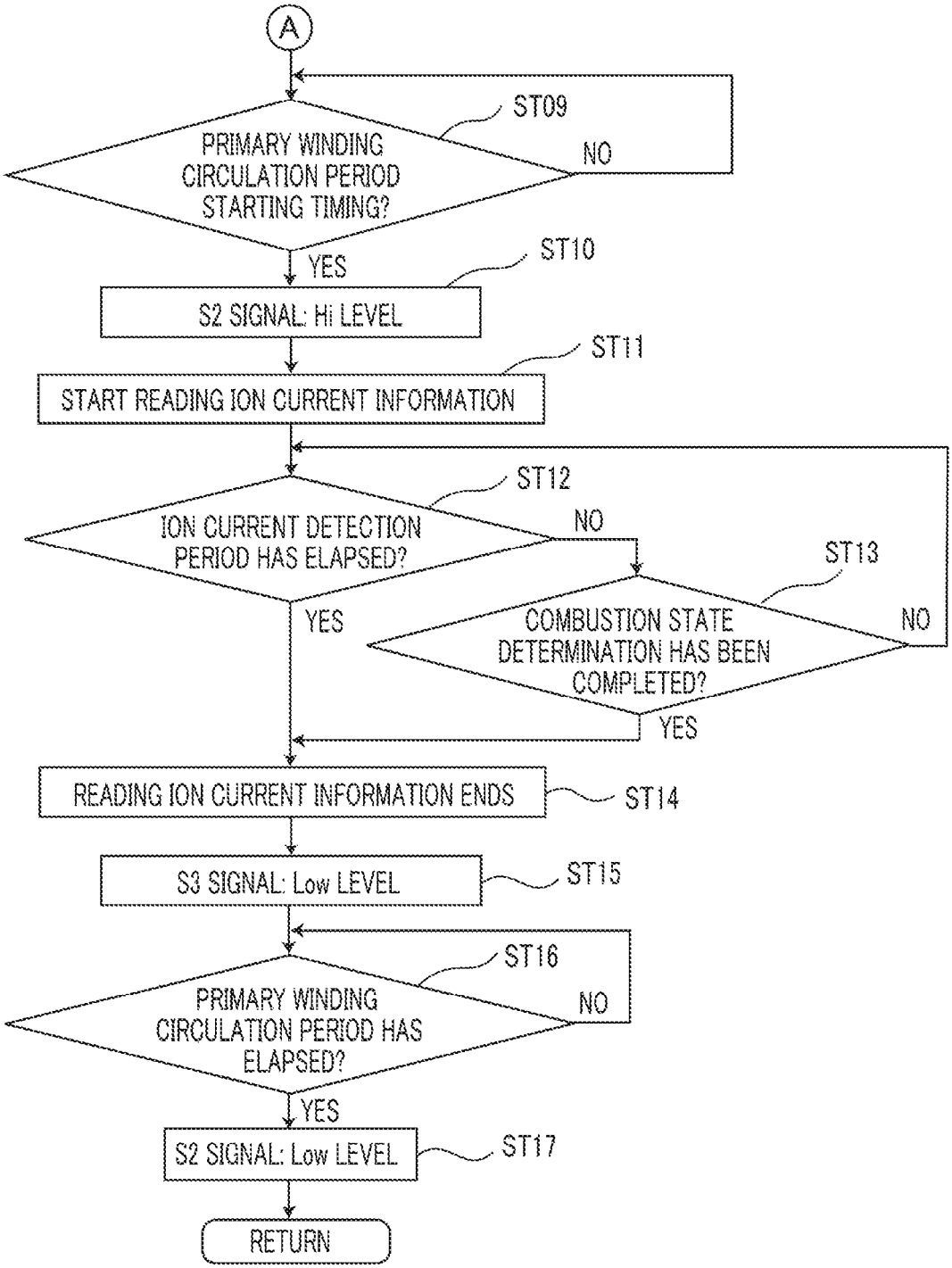
Figure 6:
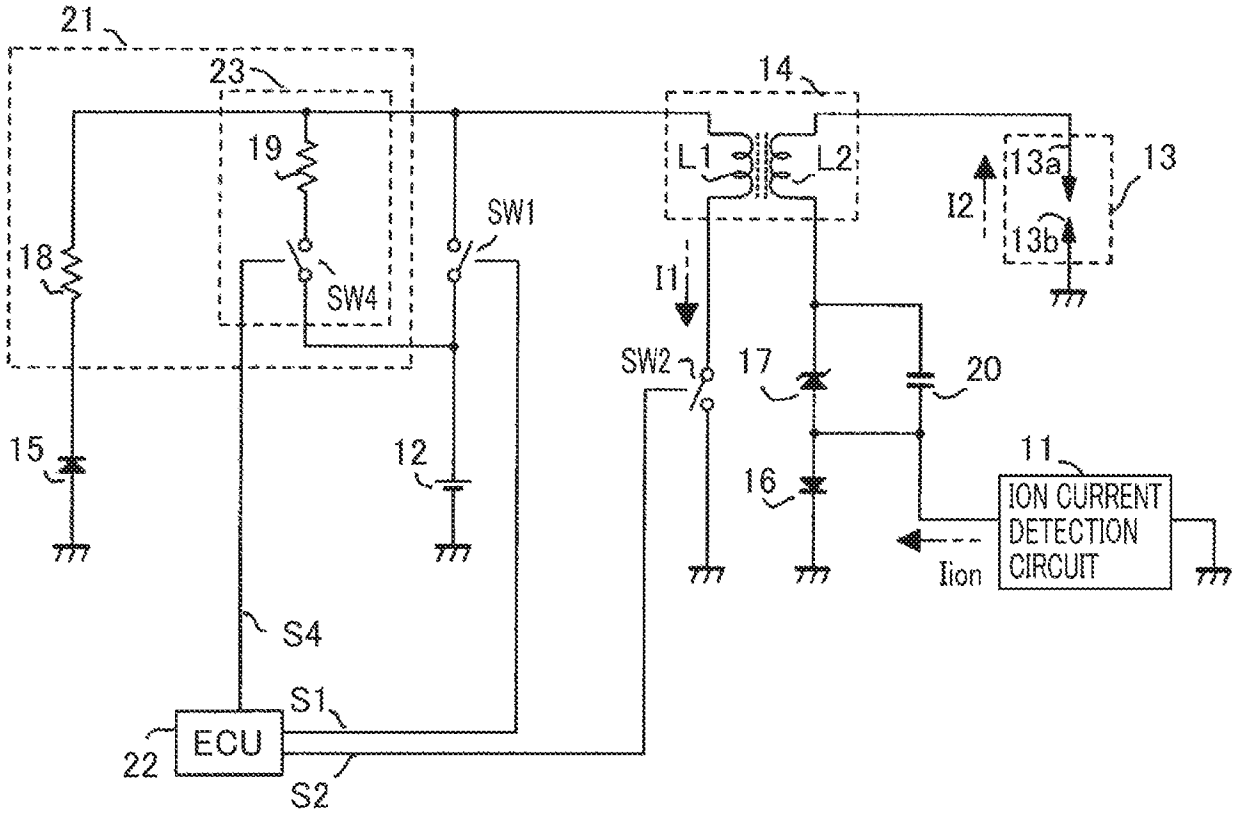
Figure 7:
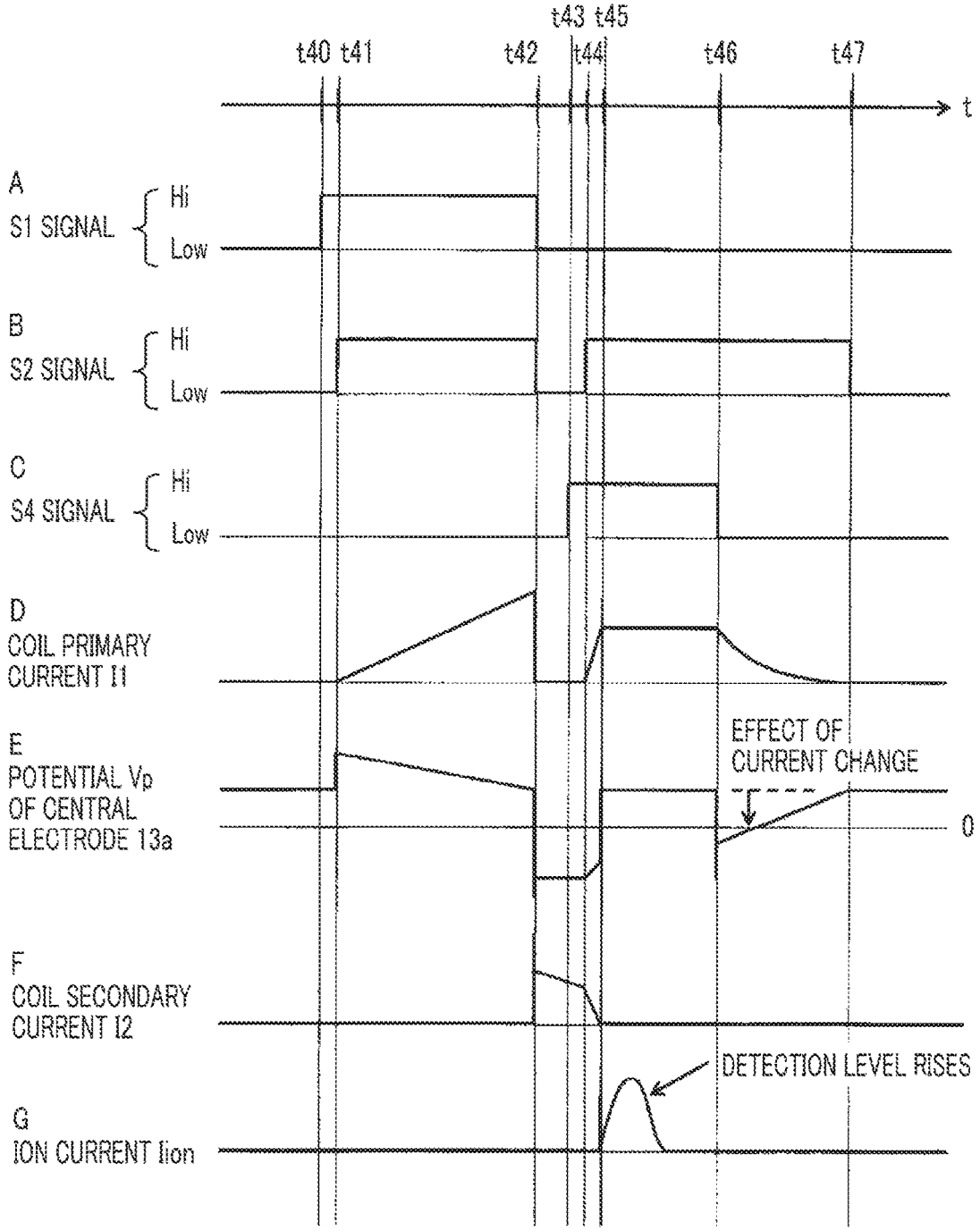
Figure 8:
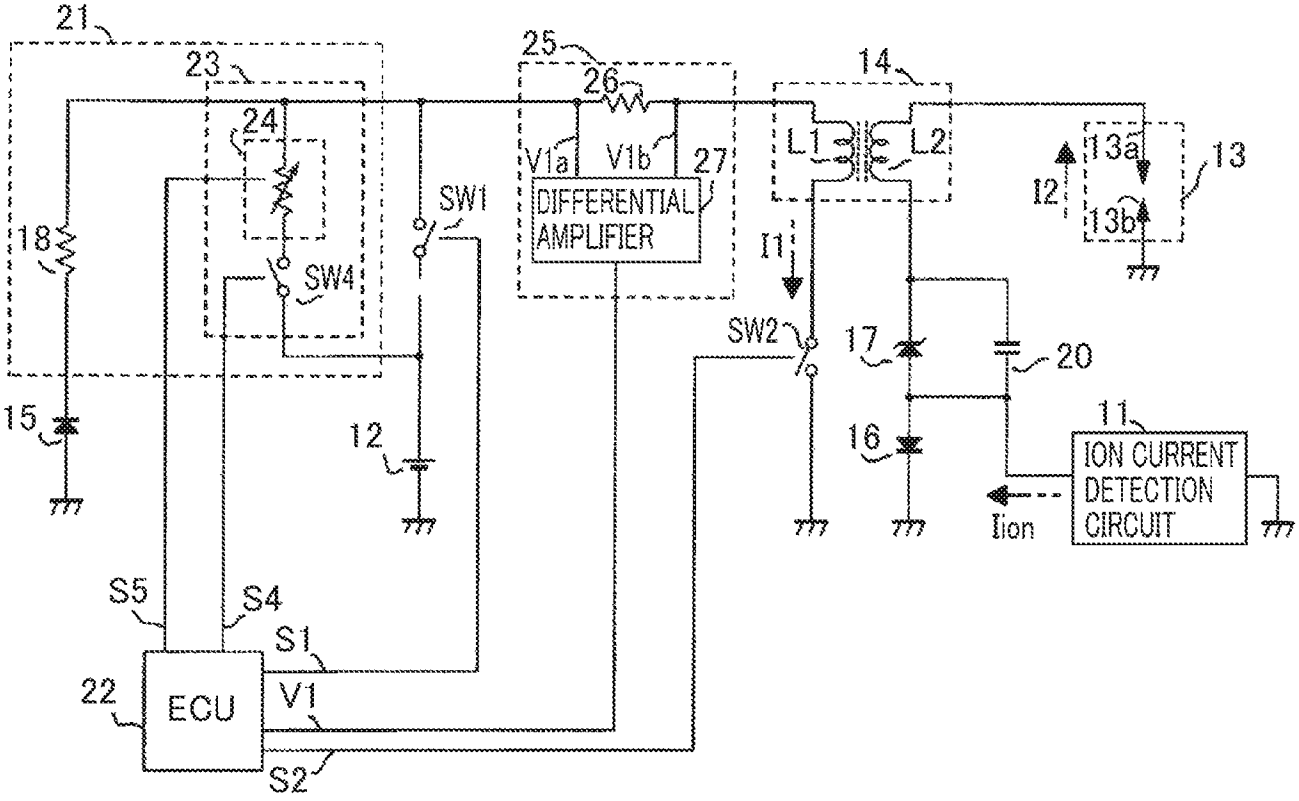
Figure 9:
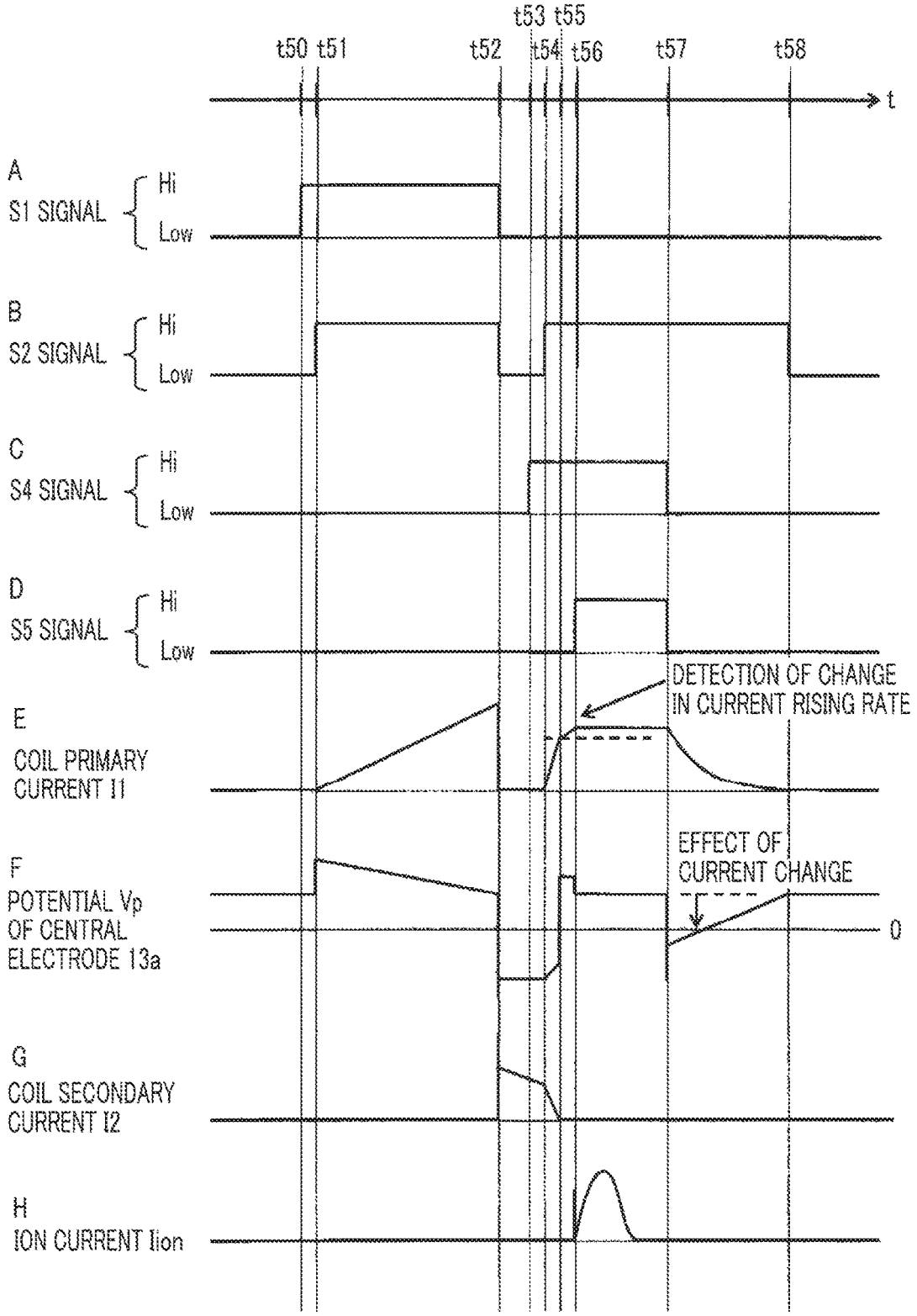
Figure 10A:
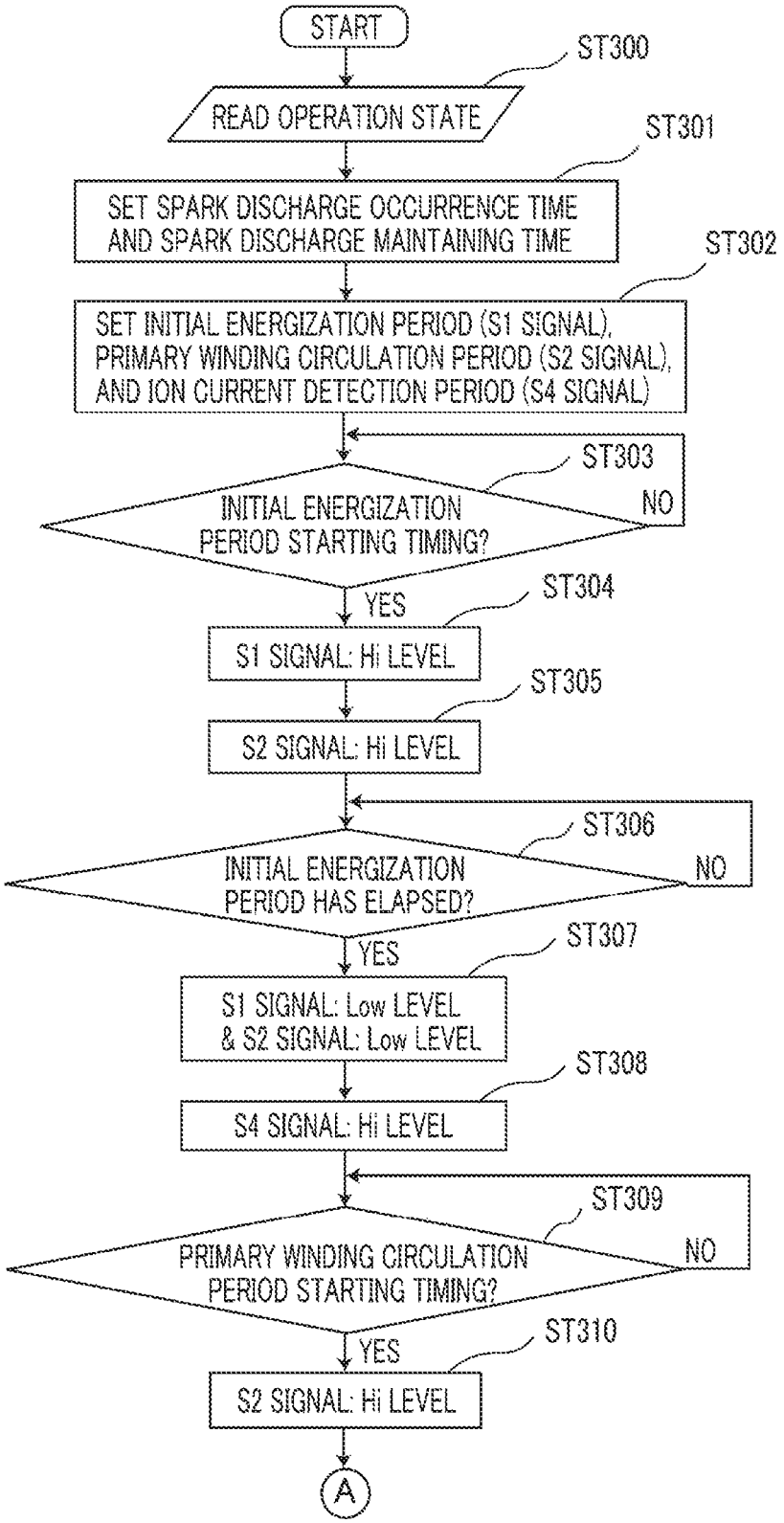
Figure 10B:
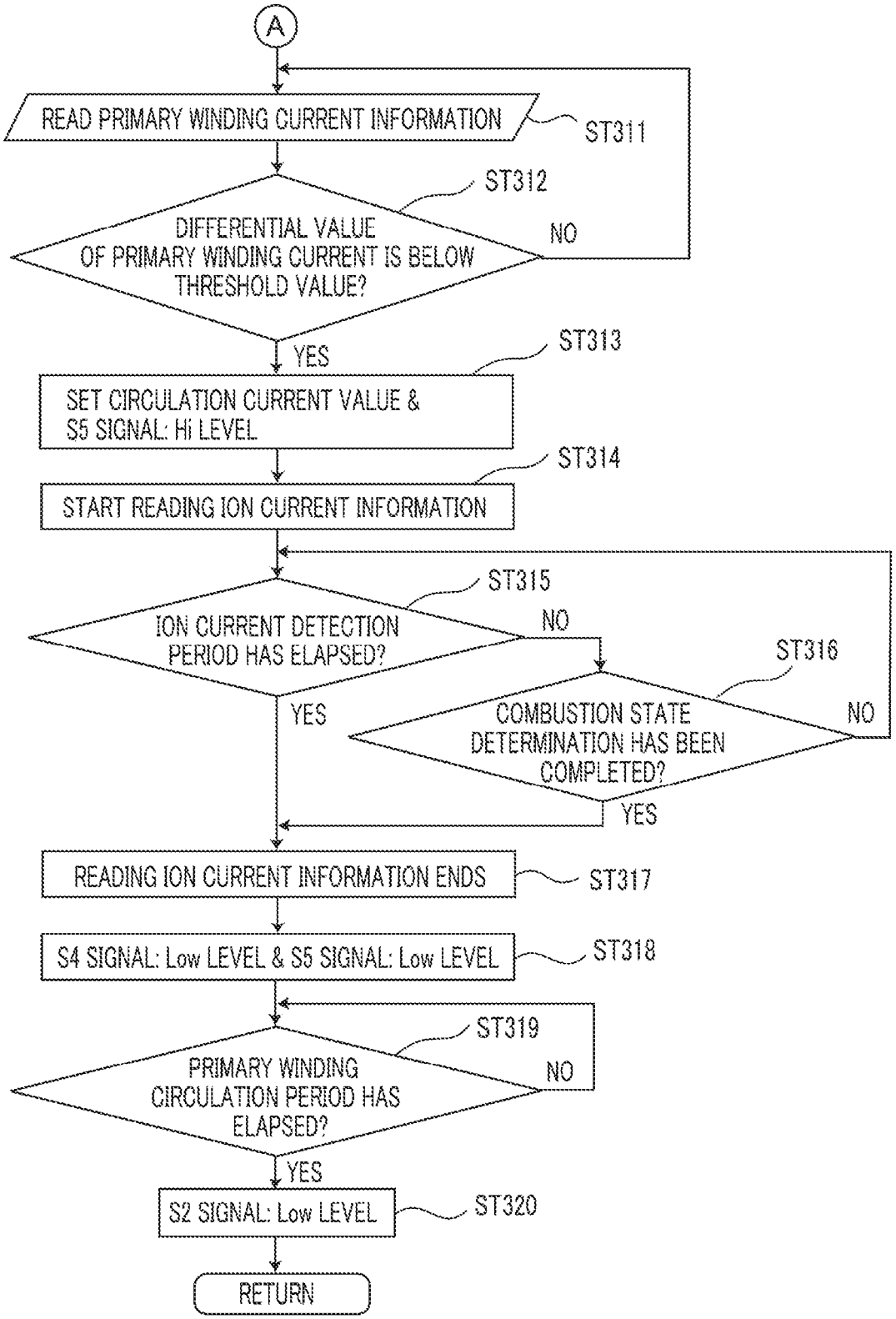
Figure 11:
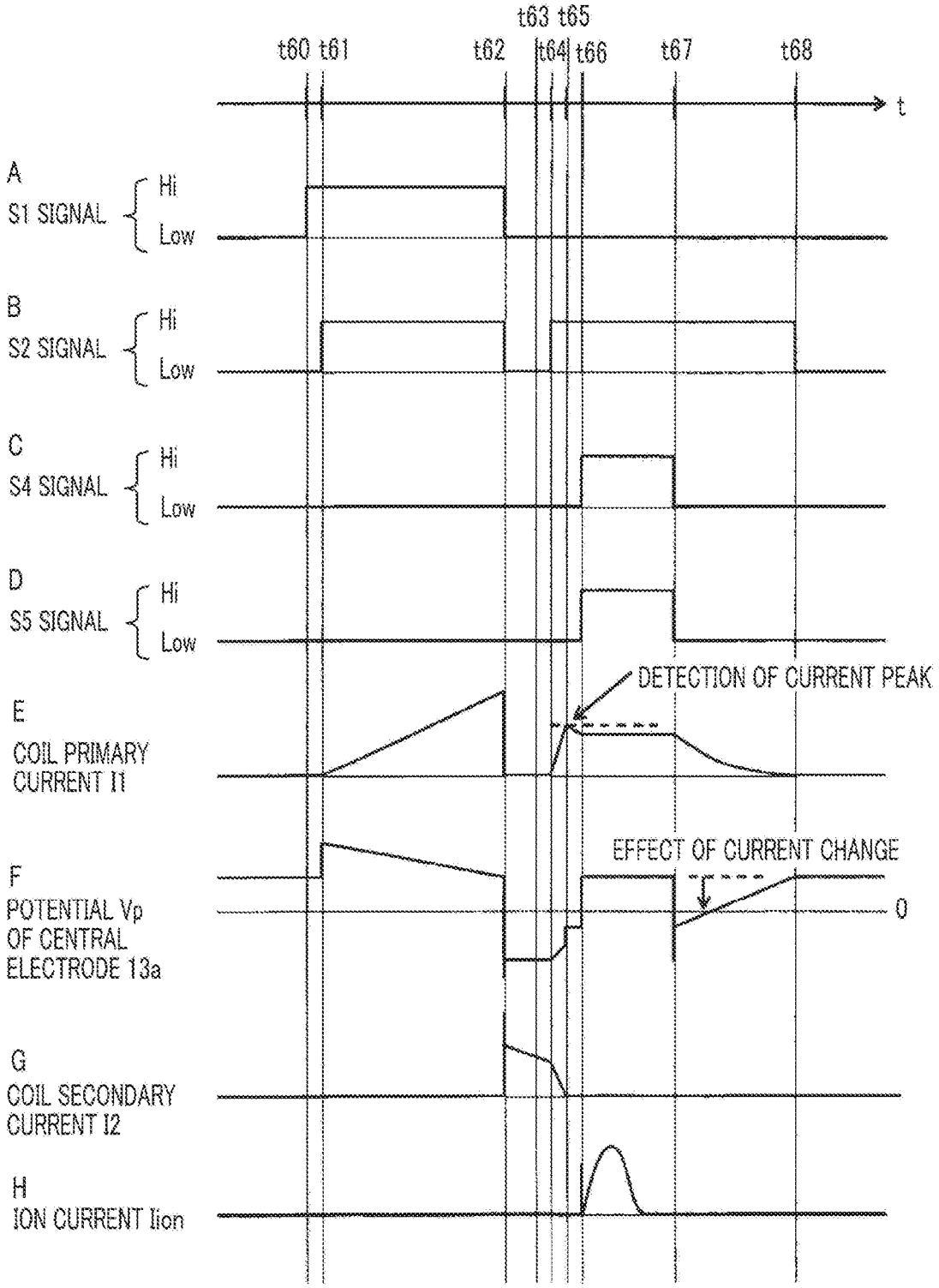
Figure 12A:
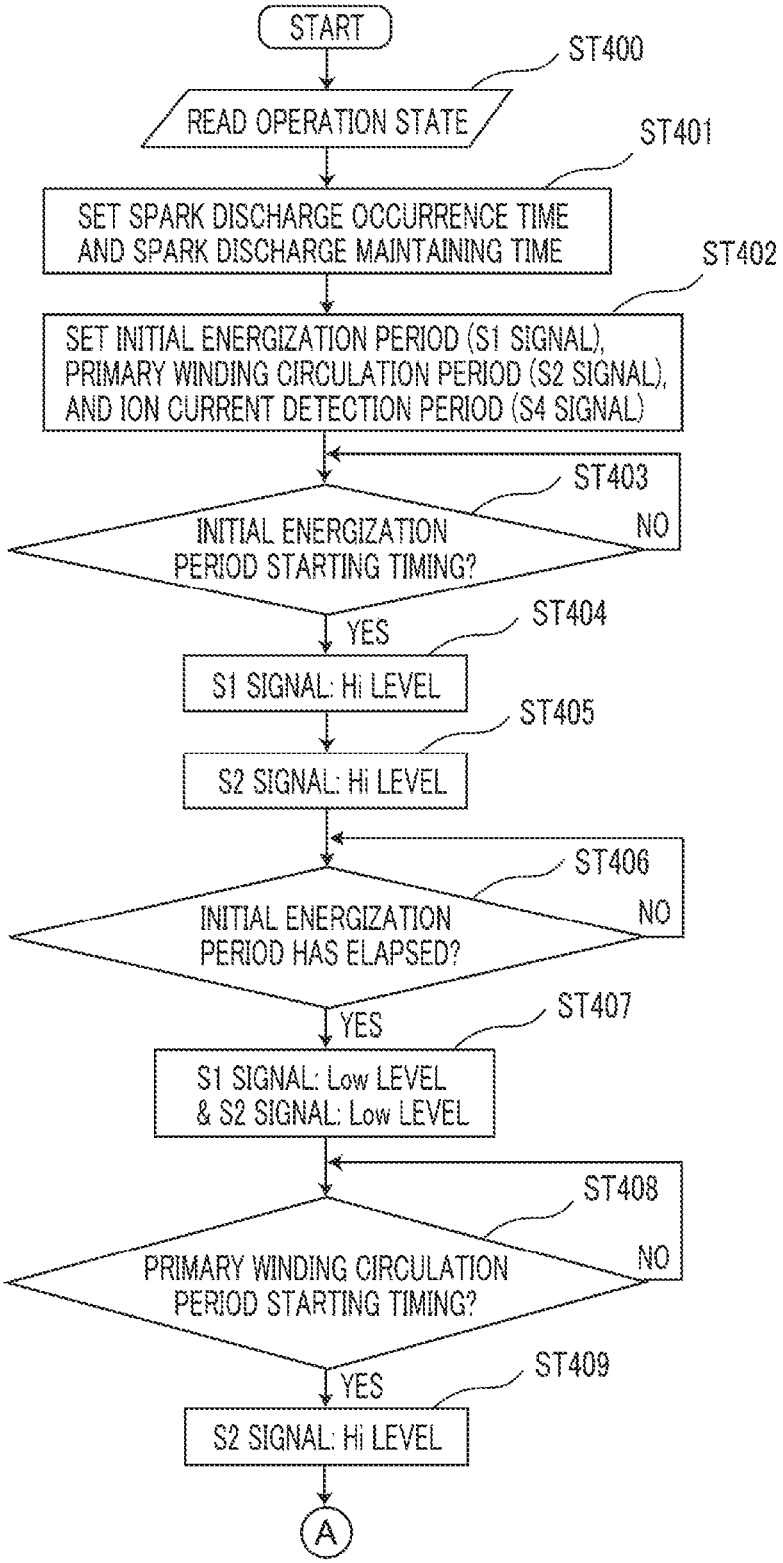
Figure 12B:
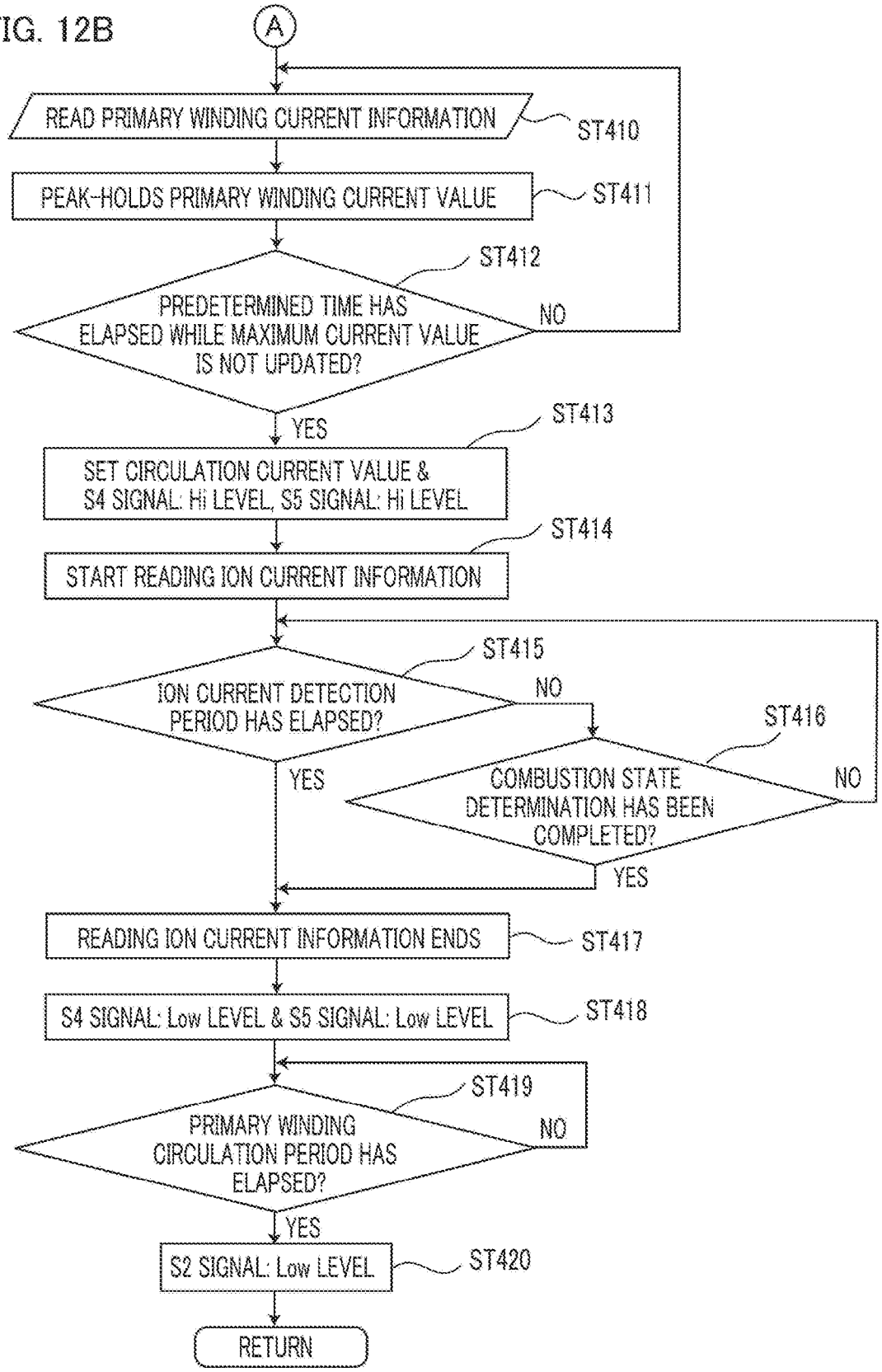

A set of FIGS. 5A and 5B is a flowchart representing the processing implemented by an electronic control unit in the internal-combustion-engine combustion state detecting apparatus according to Embodiment 1 of the present invention;

FIG. 6 is a configuration diagram representing the basic configuration of an internal-combustion-engine combustion state detecting apparatus according to Embodiment 2 of the present invention;

FIG. 7 is a timing chart representing the operation of the internal-combustion-engine combustion state detecting apparatus according to Embodiment 2 of the present invention;

FIG. 8 is an example of basic configuration of an internal-combustion-engine combustion state detecting apparatus according to any one of Embodiments 3 and 4;

FIG. 9 is a timing chart representing the operation of the internal-combustion-engine combustion state detecting apparatus according to Embodiment 3 of the present invention;

A set of FIGS. 10A and 10B is a flowchart representing the processing implemented by an electronic control unit in the internal-combustion-engine combustion state detecting apparatus according to Embodiment 3 of the present invention;

FIG. 11 is a timing chart representing the operation of the internal-combustion-engine combustion state detecting apparatus according to Embodiment 4 of the present invention; and A set of FIGS. 12A and 12B is a flowchart representing the processing implemented by an electronic control unit in the internal-combustion-engine combustion state detecting apparatus according to Embodiment 4 of the present invention.

DETAILED DESCRIPTION OF THE PREFERRED EMBODIMENTS

Technology that is a Basis of the Present Invention

Figure 1:
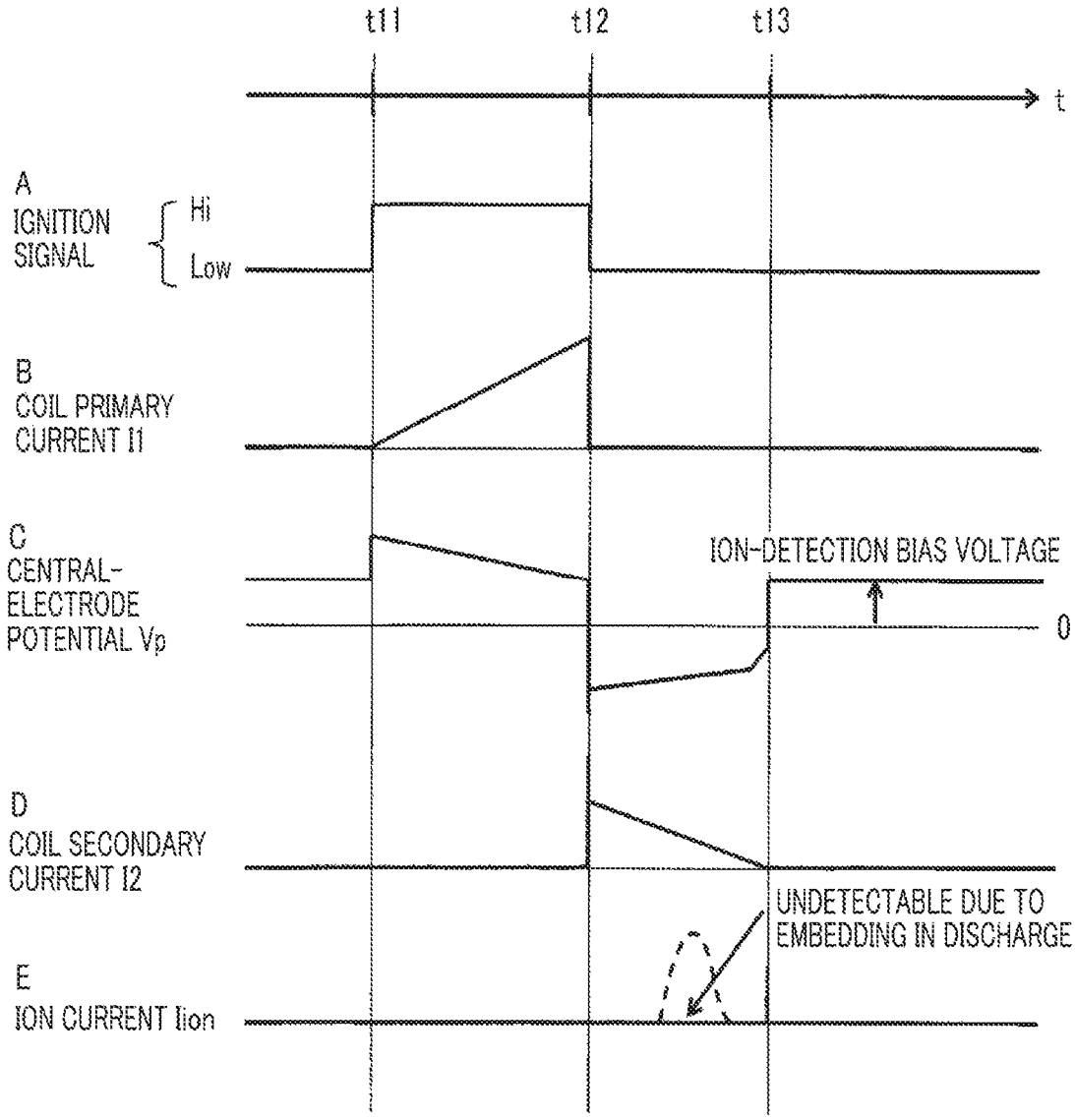
FIG. 1 is a timing chart representing the operation of an internal-combustion-engine combustion state detecting apparatus, which is a basis of the present invention.

Firstly, the technology that is a basis of the present invention will be explained. FIG. 1 is a timing chart representing the operation of an internal-combustion-engine combustion state detecting apparatus, which is a basis of the present invention; A, B, C, D, and E represent the waveform of an ignition signal, the waveform of a primary current I1 of an ignition winding, the waveform of a central-electrode potential Vp of an ignition plug, the waveform of a secondary current I2 of the ignition winding, and the waveform of an ion current Iion, respectively.

In FIG. 1, when at a time point t11, the level of the ignition signal changes from "Low" to "Hi", the primary current I1 of the ignition winding gradually increases from "0". After at the time point t11 at which its level becomes "Hi", the ignition signal rises to a level the same as or higher than an ion-detection bias voltage, the central-electrode potential Vp of the ignition plug gradually falls. When at a time point t12, the level of the ignition signal changes from "Hi" to "Low", the primary current I1 flowing in the primary winding of the ignition winding is interrupted and hence a high voltage is generated across the secondary winding of the ignition winding; then, a reverse-polarity spark discharging voltage is applied to the central electrode of the ignition plug connected with the secondary winding of the ignition winding.

As a result, a spark discharge occurs in a space between the electrodes of the ignition plug; the secondary current I2 of the ignition winding instantaneously rises at the time point t12; then, the secondary current I2 gradually decreases and becomes "0" at a time point t13. After reaching the spark discharging voltage at the time point t12, the central-electrode potential Vp of the ignition plug gradually decreases and returns to the ion-detection bias voltage applied between the electrodes of the ignition plug at the time point t13. As is well known, a present predominant ion current detection apparatus for detecting an ion current is configured in such a way that a capacitor is charged with the secondary current I2, which is a spark discharging current that is generated when a spark discharge occurs in the ignition plug, to a predetermined voltage, in such a way that after the spark discharge, the capacitor is discharged so that an ion-detection bias voltage (approximately hundred to several hundred [V]) having a polarity opposite to the polarity of the ignition high voltage is applied between the electrodes of the ignition plug, and in such a way that the ion current flowing at that moment is detected.

Because a spark discharge occurs between the electrodes of the ignition plug, ions are produced in the combustion chamber of the internal combustion engine; then, based on the foregoing ion-current detection bias voltage, an ion current flows through the electrodes of the ignition plug. After the spark discharge occurs at the time point t12, the ion current flows as represented by a waveform indicated by a broken line; however, in the case where the ignition plug is utilized as an ion current detection probe, the ion current is embedded in the discharge current caused by a spark discharge during the period of the spark discharge; therefore, the ion current cannot be detected and hence detection of the combustion state by use of the ion current cannot be performed.

Furthermore, in the case where the speed of combustion inside a cylinder is high because for example, the operation condition of the internal combustion engine is high-speed-rotation and high-load, the period (the time period between the time point t12 and the time point t13) from a time when ignition is started to a time when generation of ions produced through combustion ends becomes short; thus, as disclosed in Patent Document 2, most of the generation period of ions produced through combustion is embedded in the spark discharging period; as a result, the detection of the combustion state based on ion current information is difficult.

Accordingly, as disclosed in Patent Document 3, there has been proposed a technology in which a current-cutoff ignition apparatus is adopted and the primary winding of the ignition winding is short-circuited so that the spark discharge in a current-cutoff ignition apparatus is forcibly interrupted in process of spark discharging and hence the spark discharging time is adjusted so as to be shortened in accordance with the operation condition of the internal combustion engine. In this case, because the spark discharging time is adjusted so as to be shortened in accordance with the operation condition of the internal combustion engine, an ion current flows after the discharge current produced by the spark discharge has been extinguished; thus, because the ion current is not embedded in the discharge current produced by the spark discharge, the ion current can be detected.

Figure 2:
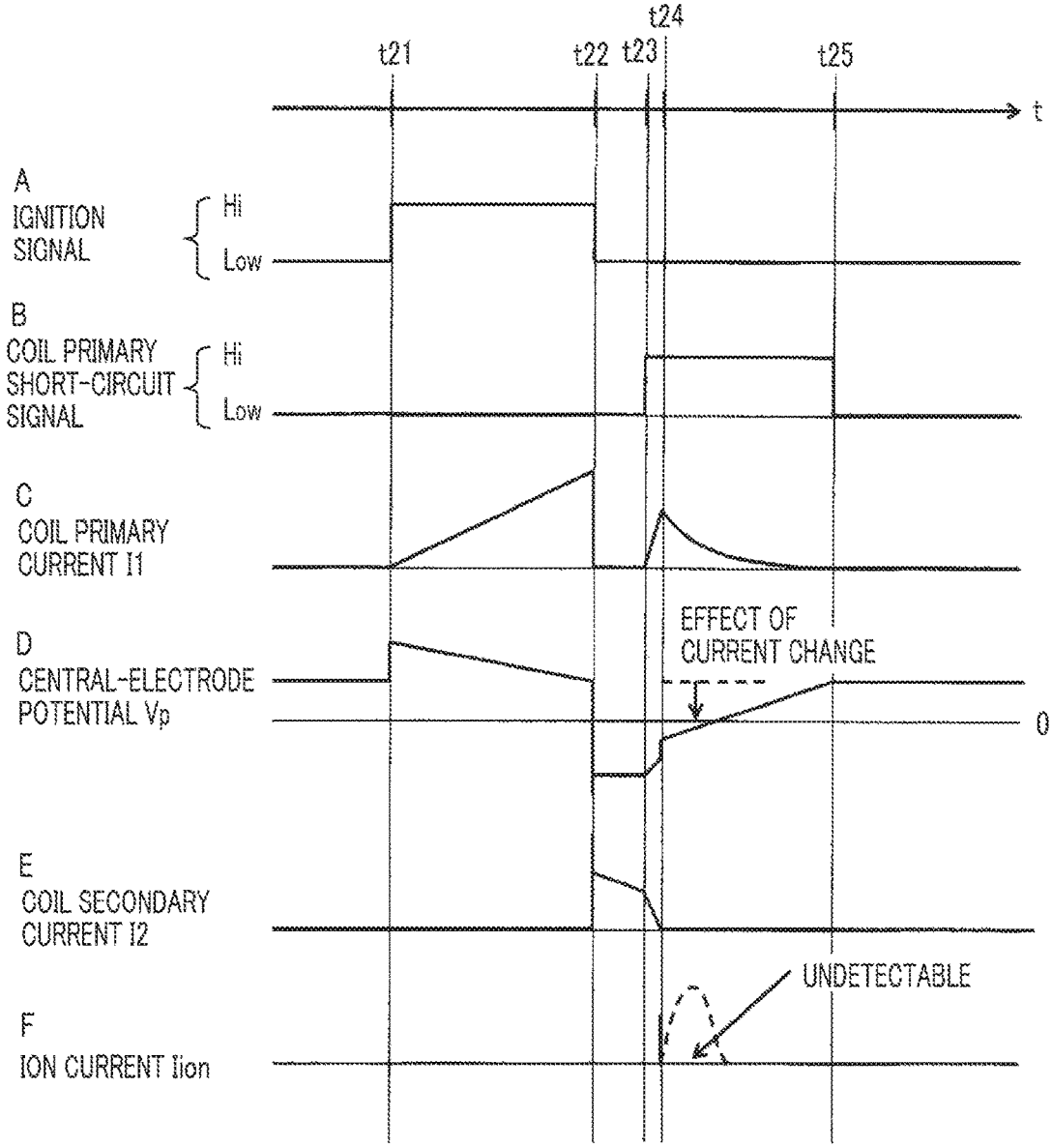
FIG. 2 is a timing chart representing the operation, when a normal discharge stopping apparatus is integrated in the internal-combustion-engine combustion state detecting apparatus, which is a basis of the present invention.

FIG. 2 is a timing chart representing the operation, when a normal discharge stopping apparatus is integrated in the internal-combustion-engine combustion state detecting apparatus, which is a basis of the present invention. In FIGS. 2, A, B, C, D, E, and F represent the waveform of the ignition signal, the waveform of a primary short-circuiting signal for the ignition winding, the waveform of the primary current I1 of the ignition winding, the waveform of the central-electrode potential Vp of the ignition plug, the waveform of the secondary current I2 of the ignition winding, and the waveform of the ion current Iion, respectively.

In FIG. 2, when at a time point t21, the level of the ignition signal changes from "Low" to "Hi", the primary current I1 of the ignition winding gradually increases from "0". After at the time point t21 at which its level becomes "Hi", the ignition signal rises to a level the same as or higher than an ion-detection bias voltage, the central-electrode potential Vp of the ignition plug gradually falls. When at a time point t22, the level of the ignition signal changes from "Hi" to "Low", the primary current I1 flowing in the primary winding of the ignition winding is interrupted and hence a high voltage is generated across the secondary winding of the ignition winding; then, a reverse-polarity spark discharging voltage is applied to the central electrode of the ignition plug connected with the secondary winding of the ignition winding.

As a result, a spark discharge occurs in a space between the electrodes of the ignition plug; the secondary current I2 of the ignition winding instantaneously rises at the time point t22; then, the secondary current I2 gradually decreases until a time point t23. The current-cutoff ignition apparatus provided with the discharge stopping apparatus has an ignition-energy-control thyristor—a voltage induced across the primary winding of the ignition winding at ignition operation is applied between the anode and the cathode thereof; the thyristor is connected in parallel with the primary winding of the ignition winding. At the time point t22 at which ignition is performed in the internal combustion engine, the primary current I1 of the ignition winding is interrupted; then, at the time point t23, which is an appropriate timing, the level of the primary short-circuiting signal for short-circuiting the primary winding of the ignition winding changes from "Low" to "Hi". As a result, the ignition-energy-control thyristor is turned on at the time point t23 and hence the primary winding of the ignition winding is short-circuited, so that the ignition output is attenuated and hence the spark discharge is stopped.

In the current-cutoff ignition apparatus provided with such a discharge stopping apparatus as described above, after the primary current I1 is interrupted, an electric current is made to flow in the primary winding at the time point t23, which is an appropriate timing, and hence the magnetic field corresponding to the magnetic flux left in the iron core of the ignition winding is generated so that spark discharging is stopped, and then, the electric current in the primary winding is gradually decreased, so that without causing discharging to occur again, the discharge stopping process is completed before the next ignition cycle of the internal combustion engine starts.

In order to clear the high-rotation-speed operation condition in which the interval of ignition is short, it is required that the primary current I1 flowing in the primary winding is quickly decreased; however, due to the decrease in the primary current I1, a voltage having a polarity the same as that of the ignition high voltage is generated across the secondary winding and is applied to the ignition plug. As is clear from the fact that the spark discharge in the ignition plug is stopped, this voltage does not reach the discharge maintaining voltage; however, a voltage, which is approximately several hundred [V], is generated while discharging is stopped.

However, the voltage that is generated across the secondary winding and has a polarity the same as that of the ignition high voltage adversely affects detection of an ion current. The reason why the foregoing voltage adversely affects detection of an ion current can be explained as follows:

As described above, in an ordinary ion current detection apparatus for detecting an ion current, a capacitor is charged with the secondary current I2, which is a spark discharging current that is generated when a spark discharge occurs in the ignition plug, to a predetermined voltage; after the spark discharge, the capacitor is discharged so that an ion-detection bias voltage (approximately hundred to several hundred [V]) having a polarity opposite to the polarity of the ignition high voltage is applied between the electrodes of the ignition plug; then, the ion current flowing at that moment is detected. Therefore, as represented in the period between t24 and t25 in FIG. 2, the voltage that is generated while the discharging is stopped and has a polarity the same as that of the ignition high voltage hinders the ion-detection bias voltage from being applied to the ignition plug and hence the performance of detecting an ion current is deteriorated or it is made impossible to detect an ion current.

Accordingly, there can be conceived countermeasures in which the capacitor is charged with a spark discharging current so that there is generated an ion-detection bias voltage that surpasses the effect of the voltage (several hundred [V]) that is generated, due to the interruption of discharging, across the secondary winding and has a polarity the same as that of the ignition high voltage; however, in that case, because the energy in the ignition winding is decreased, not only the ignition performance in an operation region where combustion is deteriorated is degraded, but also it is not realistic in terms of the durability and reliability of the ion current detection apparatus.

Embodiment 1

Figure 3:
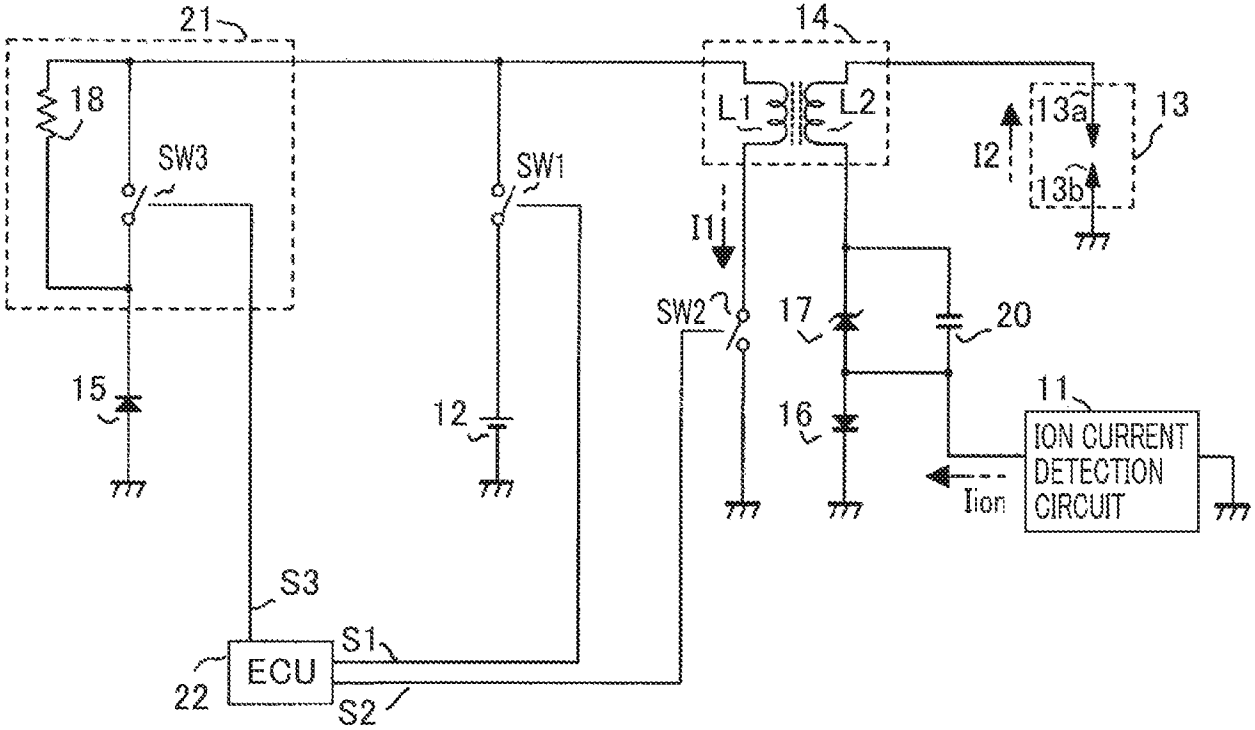
FIG. 3 is a configuration diagram representing the basic configuration of an internal-combustion-engine combustion state detecting apparatus according to Embodiment 1 of the present invention.

Hereinafter, the internal-combustion-engine combustion state detecting apparatus according to Embodiment 1 of the present invention will be explained. FIG. 3 is a configuration diagram representing the basic configuration of the internal-combustion-engine combustion state detecting apparatus according to Embodiment 1 of the present invention. In Embodiment 1 of the present invention, a single-cylinder internal combustion engine will be explained; however, an internal-combustion-engine combustion state detecting apparatus according to the present invention can be applied also to a multi-cylinder internal combustion engine. In that case, ion current detection apparatuses having the same basic configuration may be provided for the respective cylinders or the two or more cylinders may share a partial configuration element of the combustion state detecting apparatus, such as a circulation current control unit.

In FIG. 3, the internal-combustion-engine combustion state detecting apparatus according to Embodiment 1 of the present invention includes an ion current detection circuit 11 that detects an ion current, a power source apparatus 12 that outputs a constant voltage, an ignition plug 13 that is provided in a cylinder of an internal combustion engine and is provided with a first electrode 13*a*, which is a central electrode, and a second electrode 13*b* that faces the first electrode 13*a* through a predetermined gap, an ignition winding 14 having a primary winding L1 and a secondary winding L2 that is magnetically coupled with the primary winding L1 through an iron core and generates an ignition high voltage, a diode 15, for configuring a circulation unit that short-circuits the primary winding L1, that is connected in parallel with the primary winding L1, a reverse-flow prevention diode 16 connected at the low voltage side of the secondary winding L2, a Zener diode 17 inserted between the secondary winding L2 and the reverse-flow prevention diode 16, a capacitor 20 connected in parallel with the Zener diode 17, a first switch SW1 that is formed of a transistor, for example, and functions as a power source switch, a second switch SW2, for controlling ignition, that is connected in series with the primary winding L1, a circulation current control unit 21, and an electronic control unit (hereinafter, referred to as ECU) 22.

The circulation current control unit 21 includes a resistor device 18 whose one end is connected with the connection portion between the primary winding L1 and the first switch SW1 and a third switch SW3 connected in parallel with the resistor device 18. The circulation current control unit 21 is connected in series with the diode 15 included in the circulation unit, describe above. ECU 22 outputs a driving signal S1, a driving signal S2, and a driving signal S3 for the first switch SW1, the second switch SW2, and the third switch SW3, respectively.

In Embodiment 1, the circulation unit that short-circuits the primary winding L1 so as to form a circulation path including the primary winding L1 includes the diode 15 and the second switch SW2 for controlling ignition; however, as long as the primary winding L1 can be short-circuited, an arbitrary means can be utilized; for example, the circulation unit may be configured in such a way that the primary winding L1 is short-circuited by use of an arbitrary switching device such as a thyristor or a transistor.

The circulation current control unit 21 is configured with the third switch SW3 and the resistor device 18 that is connected in parallel with the third switch SW3 and adjusts the resistance value of the circulation path; however, this configuration is the most simple one for the purpose of explanation. The circulation current control unit 21 may be arbitrarily configured as long as it can control the current value in the primary winding L1. For example, the circulation current control unit 21 may be configured in such a way that the resistance value of the circulation path is precisely changed by combining a great number of sets of the resistor device and the switching device or by use of a variable resistor so that current control can be performed or in such a way that the current control is performed by use of an arbitrary constant current circuit utilizing a switching device, a power source, and the like.

When each of the driving signal S1 for the first switch SW1, the driving signal S2 for the second switch SW2, and the driving signal S3 for the third switch SW3 from ECU 22 is "Hi"-level, the corresponding switch is turned on so as to be conductive; when each of the driving signal S1 for the first switch SW1, the driving signal S2 for the second switch SW2, and the driving signal S3 for the third switch SW3 from ECU 22 is "Low"-level, the corresponding switch is turned off and hence the current is cut off. As each of the first switch SW1, the second switch SW2, and the third switch SW3, an arbitrary switching means such as an Insulated Gate Bipolar Transistor: IGBT) or a transistor can be utilized.

Thus, in the case where a spark discharge is caused to occur in the gap where the first electrode 13*a* and the second electrode 13*b* of the ignition plug 13 face each other, after the level of the driving signal S1 for the first switch SW1, which is an energizing switch for a spark discharge, is turned from "Low" to "Hi", the level of the driving signal S2 for the second switch SW2 is turned from "Low" to "Hi", so that energization of the primary winding L1 of the ignition winding 14 is started; after energization for a spark discharge is sufficiently implemented, the level of the driving signal S2 for the second switch SW2 is turned from "Hi" to "Low", so that an ignition high voltage is generated across the secondary winding L2 of the ignition winding 14; the ignition high voltage is applied between the first electrode 13*a* and the second electrode 13*b* of the ignition plug 13, so that a spark discharge occurs in the gap between the first electrode 13*a* and the second electrode 13*b* of the ignition plug 13.

Next, in the case where the level of the driving signal S1 for the first switch SW1 is "low", the level of the driving signal S2 for the second switch SW2 is "Hi", and the level of the driving signal S3 for the third switch SW3 is "Hi", the primary winding L1 of the ignition winding 14 is short-circuited by the diode 15 and hence a closed circuit including the primary winding L1 and the diode 15, i.e., the circulation path is formed. In this situation, the diode 15 permits the circulation current that flows in the primary winding L1 to flow only in a direction the same as the direction in which the current flows when energization for a spark discharge is implemented. The diode 15 is directly connected with the primary winding L1 so as to form the circulation unit including the primary winding L1.

Next, when the level of the driving signal S3 for the third switch SW3 is made "Low", the circulation current becomes to flow through the resistor device 18 and hence the resistance value of the short-circuit path for the primary winding L1 increases.

Figure 4:
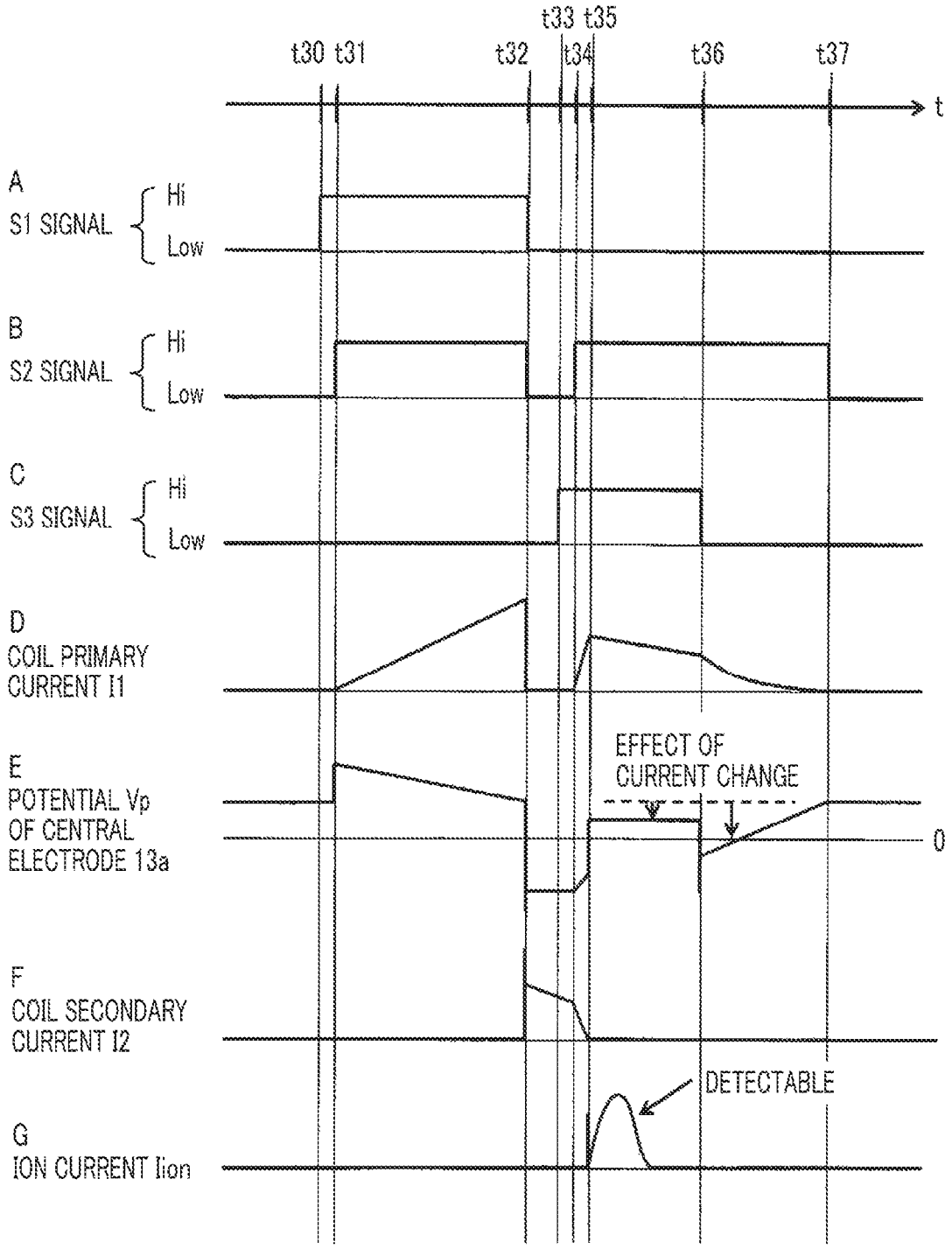
FIG. 4 is a timing chart representing the operation of the internal-combustion-engine combustion state detecting apparatus according to Embodiment 1 of the present invention.

FIG. 4 is a timing chart representing the operation of the internal-combustion-engine combustion state detecting apparatus according to Embodiment 1 of the present invention; A, B, C, D, E, F, and G represent the waveform of the driving signal S1, the waveform of the driving signal S2, the waveform of the driving signal S3, the waveform of the primary current I1, the waveform of the central-electrode potential Vp of the ignition plug, the waveform of the secondary current I2 of the ignition winding, and the waveform of the ion current Iion, respectively.

At a time point t30 in FIG. 4, after the level of the driving signal S1 for the first switch SW1 is turned from "Low" to "Hi", the level of the driving signal S2 for the second switch SW2 is turned from "Low" to "Hi" at a time point t31, so that the primary current I1 flows in the primary winding L1 of the ignition winding 14. After that, at a time point t32 when a preliminarily set energization duration has elapsed, the levels of the driving signal S1 and the driving signal S2 are changed from "Hi" to "Low", so that the primary current I1 in the primary winding L1 of the ignition winding 14 is interrupted; as a result, a negative ignition high voltage is applied to the first electrode 13*a*, which is the central electrode of the ignition plug 13, and hence the central-electrode potential Vp steeply falls; thus, a spark discharge occurs in the gap between the first electrode 13*a* and the second electrode 13*b* of the ignition plug 13.

After a spark discharge occurs in the gap between the first electrode 13*a* and the second electrode 13*b* of the ignition plug 13, the level of the driving signal S3 for the third switch SW3 is changed from "Low" to "Hi" at a time point t33; then, at a time point t34 when a spark discharging sustaining time, calculated based on the operation state of the internal combustion engine, has elapsed, the level of the driving signal S2 for the second switch SW2 is changed from "Low" to "Hi" again.

Accordingly, the primary current I1 starts to flow again in the primary winding L1; when at a time point t35, the primary current I1, which has started to flow again, reaches a current value at which a magnetic field corresponding to the magnetic flux left in the iron core of the ignition winding 14 is generated, a voltage having a polarity that is opposite to the polarity of the ignition high voltage that has been generated in the secondary winding L2 during spark discharging is induced across the secondary winding L2; thus, the voltage between the first electrode 13*a* and the second electrode 13*b* becomes lower than the discharge maintaining voltage and hence the spark discharge in the ignition plug 13 is forcibly interrupted.

Because at the time point t34, the level of the driving signal S2 for the second switch SW2 is changed from "Low" to "Hi" and the driving signal S3 for the third switch SW3 is maintained at "Hi" level, a closed circuit, as the circulation path including the primary winding L1 of the ignition winding 14 and the diode 15, is formed and an electric current starts to flow in the closed circuit. The magnetic flux that has been left in the ignition winding 14 is dissipated by the closed circuit including the diode 15 and the primary winding L1; because the circulation is made in the closed circuit having a small resistance component, the speed of the magnetic-flux dissipation in the ignition winding 14 is low; the change in the value of the electric current that flows in the primary winding L1 is small and the level of the voltage that is generated across the secondary winding L2 while the discharge is interrupted is suppressed at a low level. As a result, the effect to the ion-detection bias voltage applied to the ignition plug 13 is small.

The period from the time point t35 to a time point t36 is an ion current detection period. When at the time point t36 when the ion current detection period ends, the level of the driving signal S3 for the third switch SW3 is changed from "Hi" to "Low", the resistor device 18 is inserted into the closed circuit formed of the primary winding L1 and the diode 15 and hence the resistance component of the circulation path increases. As a result, it is made possible to accelerate the speed of the magnetic-flux dissipation in the ignition winding 14 and hence it is made possible to prevent wasteful heat generation in the winding and to prevent the discharge-interruption cycle from being prolonged.

Because the change in the electric current that flows in the primary winding L1 becomes large, the level of the voltage generated across the secondary winding L2 while the discharge is interrupted becomes high; however, because the dielectric re-breakdown voltage is overwhelmingly higher (several [kV] to several ten [kV]) than the foregoing voltage (several hundred [V]) generated across the secondary winding L2, the spark discharge between the electrodes of the ignition plug does not occur again. For example, in order to accelerate the speed of the magnetic-flux dissipation while preventing the dielectric re-breakdown from occurring again, it is advisable that the resistance component of the closed circuit is adjusted to be approximately 0.1 [Ω] to 10 [Ω].

The time point t36 can arbitrarily be determined; however, in order to suppress the heat generation in the ignition winding 14, it is advisable that the time point t36 is calculated each time the operation state of the internal combustion engine changes, that a map is created, or that the time point t36 is calculated based on the result of ion current detection by the ion current detection circuit 11. For example, in the case where the determination on the in-cylinder combustion state, based on the ion current, is completed before the ion current detection period, which has preliminarily been set based on the operation state of the internal combustion engine or the map, ends, the time point t36 may be set to the determination ending time.

When at a time point t37, the level of the driving signal S2 for the second switch SW2 is changed from "Hi" to "Low", the closed circuit formed of the primary winding L1 and the diode 15 is opened and hence the discharge interruption operation in one combustion cycle of the internal combustion engine ends.

As described above, the change in the electric current flowing in the primary winding L1 is controlled so as to become small in the period from the time point t35 to the time point t36, which is the ion current detection period; as a result, the voltage generated across the secondary winding L2 is suppressed at a low level. Accordingly, the effect to the ion-current detection bias voltage applied to the ignition plug 13 is suppressed so as to be small; thus, the ion-current detection bias voltage can stably be applied to the ignition plug 13, without largely raising the capacitor charging voltage for generating the bias voltage. Therefore, even when the discharge is being interrupted, the ion-current detection performance is not degraded or the ion-current detection is not hindered; thus, the combustion state can accurately be detected.

Moreover, because only in the ion current detection period, the control is performed in such a way that the change in the electric current flowing in the primary winding L1 while the discharge is interrupted is small or in such a way that the electric current value is constant, wasteful heat generation in the primary winding L1 can be suppressed and the prolongation of the period required for one cycle of the discharge interruption can be suppressed to a minimum; therefore, high-speed rotation of the internal combustion engine can also be dealt with. For example, it is made possible to make the foregoing period fall within the period of ATDC 90° from spark discharge interruption completion time (e.g., BTDC 10°) to the time when the exhaust stroke starts.

A set of FIGS. 5A and 5B is a flowchart representing the processing implemented by the electronic control unit in the internal-combustion-engine combustion state detecting apparatus according to Embodiment 1 of the present invention. ECU 22 is to comprehensively control the spark discharging occurrence timing, the fuel injection amount, the idling rotation speed, and the like of the internal combustion engine; for the purpose of performing ignition control processing, explained later, ECU 22 separately performs operation state detection processing for detecting the operation states of the units of the internal combustion engine, such as the intake air amount (intake pipe pressure), the rotation speed, the throttle opening degree, the coolant temperature, the intake air temperature, and the like of the internal combustion engine.

In FIGS. 5A and 5B, at first, in the step (referred to as ST, hereinafter) 00, reading of the operation state is started; in ST01, based on the read operation state, the spark discharge occurrence time and the spark discharge maintaining time are set.

Next, in ST02, based on the spark discharge occurrence time, the spark discharge maintaining time, and the operation state of the internal combustion engine, there are set the initial energization period (the "Hi"-level period of the driving signal S1) of the primary winding L1 for a spark discharge in the ignition plug 13, the circulation period (the "Hi"-level period of the driving signal S2) of the primary current in the primary winding L1 at a time when the primary winding L1 is short-circuited so that the circulation path is formed, and the ion current detection period (the "Hi"-level period of the driving signal S3). The initial value of each of the driving signals S1, S2, and S3 is "Low"-level.

In ST03, based on the set initial energization period of the primary current, it is determined whether or not the initial energization period starting timing has been reached; in the case where the initial energization period starting timing has not been reached (No), ST03 is repeated until it is determined that the initial energization period starting timing has been reached. In the case where it is determined that the initial energization period starting timing has been reached (Yes), ST03 is followed by ST04.

In ST04, the level of the driving signal S1 is changed from "Low" to "Hi"; then, in ST05, the level of the driving signal S2 is changed from "Low" to "Hi". As a result, energization of the primary winding L1 of the ignition winding 14 is started.

Next, in ST06, it is determined whether or not the initial energization period for the primary winding L1 of the ignition winding 14 has reached a preliminarily set time; in the case where the initial energization period for the primary winding L1 of the ignition winding 14 has not reached the preliminarily set time (No), ST06 is repeated until it is determined that the initial energization period for the primary winding L1 of the ignition winding 14 has reached the preliminarily set time. In the case where it is determined that the initial energization period for the primary winding L1 of the ignition winding 14 has reached the preliminarily set time (Yes), ST06 is followed by ST07.

In ST07, the level of each of the driving signals S1 and S2 is changed from "Hi" to "Low". As a result, the primary current I1 flowing in the primary winding L1 of the ignition winding 14 is interrupted; an ignition high voltage is generated across the secondary winding L2 of the ignition winding 14; then, a spark discharge is produced between the first electrode 13*a* and the second electrode 13*b* of the ignition plug 13.

After the spark discharge in ST07, the level of the driving signal S3 is changed from "Low" to "Hi" in ST08 so that there is made preparations for short-circuiting the primary winding L1 of the ignition winding 14 in order to interrupt the discharge. In this situation, because the driving signal S2 is "Low"-level, the primary winding L1 of the ignition winding 14 is not short-circuited.

Next, in ST09, it is determined whether or not a preliminarily set primary winding circulation period starting timing has been reached; in the case where it is determined that the preliminarily set primary winding circulation period starting timing has not been reached (No), ST09 is repeated until it is determined that the preliminarily set primary winding circulation period starting timing has been reached; in the case where the preliminarily set primary winding circulation period starting timing has been reached (Yes), ST09 is followed by ST10.

In ST10, when the level of the driving signal S2 is changed from "Low" to "Hi" and hence the primary winding L1 of the ignition winding 14 is short-circuited, an electric current starts to flow in the primary winding L1, so that the spark discharge is forcibly interrupted. After the discharge is stopped, the circulation current control unit 21 performs control in such a way the change in the primary current I1 flowing in the primary winding L1 becomes small.

After the spark discharge is stopped in ST10, reading of ion current information detected by the ion current detection circuit 11 is started in ST11.

Next, in ST12, it is determined whether or not a preliminarily set ion current detection period ending time has been reached; in the case where it is determined that the preliminarily set ion current detection period ending time has not been reached (No), ST12 is followed by ST13; in the case where it is determined that the preliminarily set ion current detection period ending time has been reached (Yes), ST12 is followed by ST14.

In ST13, based on ion current detection information, it is determined whether or not ECU 22 has completed its combustion state determination. In the case where it is determined that ECU 22 has not completed its combustion state determination (No), ST12 is resumed; in the case where it is determined that ECU 22 has completed its combustion state determination (Yes), ST13 is followed by ST14 before the preliminarily set ion current detection period ends.

In ST14, the reading of the ion current detection information is ended; then, in ST15, the level of the driving signal S3 is changed from "Hi" to "Low", so that due to the circulation in the closed circuit having a large resistance component, the magnetic energy left in the ignition winding is actively dissipated.

Next, in ST16, it is determined whether or not a preliminarily set primary winding circulation period ending time has been reached; in the case where it is determined that the preliminarily set primary winding circulation period ending time has not been reached (No), ST16 is repeated; in the case where it is determined that the preliminarily set primary winding circulation period ending time has been reached (Yes), ST16 is followed by ST17.

In ST17, the level of the driving signal S2 is changed from "Hi" to "Low" and hence the short-circuit path for the primary winding L1 is opened; then, the ion current detection processing performed by ECU 22 is completed. Because as described above, only in the ion current detection period, the control is performed in such a way that the change in the value of the electric current flowing in the primary winding L1 becomes small or in such a way that the current value is constant, the time of superfluous energization of the primary winding L1 is shortened as much as possible and hence wasteful heat generation in the ignition winding 14 can be suppressed.

In Embodiment 1, the ending time of the primary winding circulation period is preliminarily set based on the operation state of the internal combustion engine; however, it may be allowed that the value of the electric current in the primary winding L1 is measured by use of an arbitrary current detection means such as a sensing resistor so that the ending time of the primary winding circulation period is determined in real time.

Embodiment 2

Next, an internal-combustion-engine combustion state detecting apparatus according to Embodiment 2 of the present invention will be described. In foregoing Embodiment 1, by adjusting the resistance value of the closed circuit for short-circuiting the primary winding L1, the change in the electric current flowing in the primary winding L1 is controlled so as to become small. However, because it is not possible to make zero the resistance components such as the winding resistance of the primary winding L1 and the On-resistance of the switching device, the magnetic flux in the iron core is gradually dissipated and hence the electromotive force decreases; thus, the considerable decrease in the electric current is caused while the discharge is interrupted. Accordingly, the voltage that is generated across the secondary winding L2 during circulation and has a polarity the same as that of the ignition high voltage cannot completely be prevented from being generated. Therefore, as the central-electrode potential represented in FIG. 4, the ion-detection bias voltage considerably falls during ion detection period. When the ion-detection bias voltage decreases, the ion current detection level falls under the condition where the occurrence amount of ion produced by combustion is small, such as the condition of a high EGR (exhaust gas recirculation) rate of the internal combustion engine, the condition of lean combustion, or the like; thus, the detection of combustion state may become difficult.

In such a case, as partially described in Embodiment 1, it is advisable that the circulation current control unit is configured in such a way as to perform the current control through an arbitrary constant current circuit utilizing a switching device, a power source, or the like so that the current control is performed in such a way that the value of the electric current flowing in the primary winding L1 during the ion current detection period becomes constant. The change in the voltage across the secondary winding L2 caused by the change in the electric current in the primary winding L1 is determined by the characteristics of the ignition winding, such as turn ratio of the secondary winding L2 to the primary winding L1 and the like; when the change in the electric current is made zero, the discharge interruption operation provides no effect to the secondary winding L2. Accordingly, the ion-current detection bias voltage is applied to the plug, without falling; thus, the ion current detection can more stably and accurately be performed.

FIG. 6 is a configuration diagram representing the basic configuration of the internal-combustion-engine combustion state detecting apparatus according to Embodiment 2 of the present invention. In Embodiment 2 represented in FIG. 6, control through a constant-current power source is actively performed in such a way that the electric current flowing in the primary winding becomes constant; Embodiment 2 is a most simple example for enhancing the ion-current detection performance. In the explanation below, a single-cylinder internal combustion engine will be explained; however, an internal-combustion-engine combustion state detecting apparatus according to the present invention can be applied also to a multi-cylinder internal combustion engine. In that case, ion current detection apparatuses having the same basic configuration may be provided for the respective cylinders or the two or more cylinders may share a partial configuration element of the combustion state detecting apparatus, such as a circulation current control unit.

In FIG. 6, the internal-combustion-engine combustion state detecting apparatus according to Embodiment 2 of the present invention includes the ion current detection circuit 11, as the ion current detection apparatus, that detects an ion current, the power source apparatus 12 that outputs a constant voltage, the ignition plug 13 provided in a cylinder of an internal combustion engine, the ignition winding 14 that includes the primary winding L1 and the secondary winding L2 and generates an ignition high voltage, the diode 15, for configuring a circulation unit that short-circuits the primary winding L1, that is connected in parallel with the primary winding L1, the reverse-flow prevention diode 16 connected at the low voltage side of the secondary winding L2, the Zener diode 17 inserted between the secondary winding L2 and the reverse-flow prevention diode 16, the capacitor 20 connected in parallel with the Zener diode 17, the first switch SW1 functions as a power source switch (for example, a transistor), the second switch SW2, for controlling ignition, that is connected in series with the primary winding L1, the resistor device 18 as a magnetic-flux dissipation device in the circulation current control unit 21, a resistor device 19 and a fourth switch SW4 included in a constant-current limiting unit 23, and the electronic control unit (hereinafter, referred to as ECU) 22.

In the foregoing circulation current control unit 21, one end of the resistor device 18 is connected with connection portion between the primary winding L1 and the first switch SW1, and the other end thereof is connected with the diode 15. One end of the resistor device 19 is connected with the connection portion between the primary winding L1 and the first switch SW1, and the other end thereof is connected with the fourth switch SW4. The fourth switch SW4 is connected between the resistor device 19 and the power source apparatus 12. ECU 22 outputs the driving signal S1, the driving signal S2, and a driving signal S4 for the first switch SW1, the second switch SW2, and the fourth switch SW4, respectively.

In Embodiment 2, the circulation unit consists of the diode 15 and the second switch SW2 for controlling ignition; however, the circulation unit may be formed of another arbitrary means, as long as the primary winding L1 can be short-circuited; for example, the primary winding L1 may be short-circuited by use of an arbitrary switching device such as a thyristor or a transistor.

For the sake of explanation, the constant-current limiting unit 23 in the circulation current control unit 21 consists of the fourth switch SW4 and the resistor device 19 so as to become simple; however, this is the most simple configuration example for the sake of explanation; because it is only necessary that the electric current flowing in the primary winding L1 can be controlled to be constant, the circulation current control unit 21 may be formed in another manner. For example, by combining a great number of sets of a resistor device and a switching device, by use of a variable resistor or the like, or by controlling the base current of a transistor, the electric current can precisely be controlled. As the resistor device 18 for dissipating the magnetic flux, an arbitrary load device such as a variable resistor can be utilized.

When each of the driving signal S1 for the first switch SW1, the driving signal S2 for the second switch SW2, and the driving signal S4 for the fourth switch SW4 from ECU 22 is "Hi"-level, the corresponding switch is turned on so as to be conductive. In this situation, as each of the switches, an arbitrary switching means such as an IGBT or a transistor can be utilized.

Thus, in the case where a spark discharge is caused to occur in the gap between the first electrode 13*a* and the second electrode 13*b* of the ignition plug 13, after the level of the driving signal S1 for the first switch SW1, which is an energizing switch for a spark discharge, is turned from "Low" to "Hi", the level of the driving signal S2 for the second switch SW2 is turned from "Low" to "Hi", so that energization of the primary winding L1 of the ignition winding 14 is started; after energization for a spark discharge is sufficiently implemented, the level of the driving signal S2 for the second switch SW2 is turned from "Hi" to "Low", so that an ignition high voltage is generated across the secondary winding L2 of the ignition winding 14; the ignition high voltage is applied to the ignition plug 13, so that a spark discharge occurs in the gap between the first electrode 13*a* and the second electrode 13*b* of the ignition plug 13.

Next, in the case where the level of the driving signal S1 for the first switch SW1 is "low", the level of the driving signal S2 for the second switch SW2 is "Hi", and the level of the driving signal S4 for the fourth switch SW4 is "Hi", the primary winding L1 of the ignition winding 14 and the constant-current limiting unit 23 form a closed circuit.

Next, in the case where the level of the driving signal S1 for the first switch SW1 is "low", the level of the driving signal S2 for the second switch SW2 is "Hi", and the level of the driving signal S4 for the fourth switch SW4 is "low", the primary winding L1 of the ignition winding 14 is short-circuited by the diode 15 and hence a closed circuit including the primary winding L1, the diode 15, and the resistor device 18 is formed. In this situation, the diode 15 permits the electric current that flows in the primary winding L1 to flow only in a direction the same as the direction in which the electric current flows when energization for a spark discharge is implemented.

FIG. 7 is a timing chart representing the operation of the internal-combustion-engine combustion state detecting apparatus according to Embodiment 2 of the present invention; A, B, C, D, E, F, and G represent the waveform of the driving signal S1, the waveform of the driving signal S2, the waveform of the driving signal S4, the waveform of the primary current I1, the waveform of the central-electrode potential Vp of the ignition plug, the waveform of the secondary current I2 of the ignition winding, and the waveform of the ion current Iion, respectively.

In FIG. 7, at a time point t40, after the level of the driving signal S1 for the first switch SW1 is turned from "Low" to "Hi", the level of the driving signal S2 for the second switch SW2 is turned from "Low" to "Hi" at a time point t41, so that the primary current I1 flows in the primary winding L1 of the ignition winding 14. After that, at a time point t42 when a preliminarily set energization duration has elapsed, the levels of the driving signal S1 and the driving signal S2 are changed from "Hi" to "Low", so that the primary current I1 in the primary winding L1 of the ignition winding 14 is interrupted; as a result, a negative ignition high voltage is applied to the first electrode 13*a*, as the central electrode of the ignition plug 13, and hence the central-electrode potential Vp steeply falls; thus, a spark discharge occurs in the gap between the first electrode 13*a* and the second electrode 13*b* of the ignition plug 13.

After a spark discharge occurs in the gap between the first electrode 13*a* and the second electrode 13*b* of the ignition plug 13, the level of the driving signal S4 for the fourth switch SW4 is changed from "Low" to "Hi" at a time point t43. Then, at a time point t44 when a spark discharging sustaining time, calculated based on the operation state of the internal combustion engine, has elapsed, the level of the driving signal S2 for the second switch SW2 is changed from "Low" to "Hi" again, so that the electric current starts to flow again in the primary winding L1 through the constant-current limiting unit 23.

Then, when at a time point t45, the primary current I1, which has started to flow again, reaches a current value at which a magnetic field corresponding to the magnetic flux left in the iron core of the ignition winding 14 is generated, a voltage having a polarity that is opposite to the polarity of the ignition high voltage that is generated in the secondary winding L2 when a spark discharge occurs is induced across the secondary winding L2; thus, when the voltage between the first electrode 13*a* and the second electrode 13*b* becomes lower than the discharge maintaining voltage, the spark discharge in the ignition plug 13 is forcibly interrupted. The resistance value of the resistor device 19 included in the constant-current limiting unit 23 is adjusted in such a way that the primary current I1 becomes constant and has a current value that is adequate for interrupting the discharge.

At the time point t45, a closed circuit consisting of the constant-current limiting unit 23 and the power source apparatus 12 is formed at the primary winding L1 side of the ignition winding 14; then, a constant primary current I1 starts to flow in the closed circuit. Because the change in the electric current is made to zero during the interruption of discharge, no voltage to be caused by the interruption of discharge is generated across the secondary winding L2; therefore, because the interruption of discharge provides no effect to the ion-detection bias voltage, a stable voltage from the capacitor 20 is applied between the electrodes of the ignition plug 13.

At a time point t46 when the period from the time point t45 to the time point t46, which is the ion current detection period, ends, the level of the driving signal S4 for the fourth switch SW4 is changed from "Hi" to "Low", so that the closed circuit formed of the primary winding L1 and the constant-current limiting unit 23 is opened.

After that, the primary winding L1 of the ignition winding 14 is short-circuited by the diode 15, so that a closed circuit that includes the primary winding L1, the diode 15, and the resistor device 18 and has a large resistance component is formed. As a result, it is made possible to accelerate the speed of the magnetic-flux dissipation in the ignition winding 14 and hence it is made possible to prevent wasteful heat generation in the ignition winding 14 and to prevent the discharge-interruption cycle from being prolonged. Because the change in the electric current that flows in the primary winding L1 becomes large, the level of the voltage generated across the secondary winding L2 while the discharge is interrupted becomes high; however, because the dielectric re-breakdown voltage is overwhelmingly higher (several [kV] to several ten [kV]) than the foregoing voltage (several hundred [V]) generated across the secondary winding L2, the spark discharge between the electrodes of the ignition plug 13 does not occur again. For example, in order to accelerate the speed of the magnetic-flux dissipation while preventing the dielectric re-breakdown from occurring again, it is advisable that the resistance component of the closed circuit is adjusted to be approximately 0.1 [Ω] to 10 [Ω].

The time point t46 can arbitrarily be determined; however, in order to suppress the heat generation in the ignition winding 14, it is advisable that the time point t46 is calculated each time the operation state of the internal combustion engine changes, that a map is created, or that the time point t46 is calculated based on the result of the ion current detection. For example, in the case where the determination on the combustion state in the cylinder of the internal combustion engine, based on the ion current, is completed before the ion current detection period, which has preliminarily been set based on the operation state of the internal combustion engine or the map, ends, the time point t46 may be set to the determination ending time.

When at a time point t47, the level of the driving signal S2 for the second switch SW2 is changed from "Hi" to "Low", the closed circuit formed of the primary winding L1, the diode 15, and the resistor device 18 is opened and hence the discharge interruption operation in one combustion cycle of the internal combustion engine ends. In Embodiment 2, the power source apparatus 12 is commonly utilized as the power source for the circulation current control unit 21 and as the power source for making the primary current flow in order to cause a spark discharge to occur in the ignition plug 13; however, respective separate power sources therefor may be utilized without commonly utilizing the power source apparatus 12.

As described above, no change in the electric current flowing in the primary winding L1 occurs in the period from the time point t45 to the time point t46, which is the ion current detection period; thus, no voltage is generated across the secondary winding L2 and hence the discharge interruption provides no effect to the ion-detection bias voltage. Accordingly, as is the case with the conventional ion current detection apparatus, a stable ion-detection bias voltage from the capacitor is applied to the ignition-plug electrode. As described above, it is not necessary that in order to surpass the voltage that is generated while the discharge is interrupted and has a polarity the same as that of the ignition high voltage, the charging voltage of the capacitor for generating the bias voltage is raised by approximately several hundred [V]; therefore, even during interruption of the discharge, it is made possible to perform stable and high-accuracy ion current detection by use of a capacitor charging voltage that is as high as the conventional one.

Moreover, because only in the ion current detection period, the control is performed in such a way that the value of the electric current flowing in the primary winding L1 during interruption of discharge is constant, wasteful heat generation in the primary winding L1 can be suppressed and the prolongation of the period required for one cycle of the discharge interruption can be suppressed to a minimum; therefore, high-speed rotation of the internal combustion engine can also be dealt with.

Embodiment 3

Next, an internal-combustion-engine combustion state detecting apparatus according to Embodiment 3 of the present invention will be described. In Embodiment 3 of the present invention, how to determine a circulation current limiting value, which has not been described in detail in Embodiment 2, is specifically explained. FIG. 8 is an example of the basic configuration of an internal-combustion-engine combustion state detecting apparatus according to any one of Embodiment 3 and Embodiment 4, described later. In Embodiment 3, a single-cylinder internal combustion engine will be explained; however, the present invention can be applied also to a multi-cylinder internal combustion engine. In that case, ion current detection apparatuses having the same basic configuration may be provided for the respective cylinders or the two or more cylinders may share a partial configuration element of the combustion state detecting apparatus, such as a circulation current control unit.

In FIG. 8, the internal-combustion-engine combustion state detecting apparatus according to Embodiment 3 of the present invention includes the ion current detection circuit 11, as the ion current detection apparatus, that detects an ion current, the power source apparatus 12 that outputs a constant voltage, the ignition plug 13 provided in a cylinder of an internal combustion engine, the ignition winding 14 that includes the primary winding L1 and the secondary winding L2 and generates an ignition high voltage, the diode 15, for configuring a circulation unit that short-circuits the primary winding L1, that is connected in parallel with the primary winding L1, the reverse-flow prevention diode 16 connected at the low voltage side of the secondary winding L2, the Zener diode 17 inserted between the secondary winding L2 and the reverse-flow prevention diode 16, the capacitor 20 connected in parallel with the Zener diode 17, the first switch SW1 functions as a power source switch (for example, a transistor), the second switch SW2, for controlling ignition, that is connected in series with the primary winding L1, the resistor device 18 as a magnetic-flux dissipation device in the circulation current control unit 21, the electronic control unit (hereinafter, referred to as ECU) 22, and a current detection resistor 26 and a differential amplifier 27 that are included in a current detection device 25 for measuring the current value of a circulation current and inputting it to ECU 22.

In the foregoing circulation current control unit 21, one end of the resistor device 18 is connected with connection portion between the primary winding L1 and the first switch SW1, and the other end thereof is connected with the diode 15. One end of the resistor device 19 is connected with the connection portion between the primary winding L1 and the first switch SW1, and the other end thereof is connected with the fourth switch SW4. The fourth switch SW4 is connected between the resistor device 19 and the power source apparatus 12. ECU 22 outputs the driving signal S1, the driving signal S2, and a driving signal S4 for the first switch SW1, the second switch SW2, and the fourth switch SW4, respectively.

In Embodiment 3, the circulation unit consists of the diode 15 and the second switch SW2 for controlling ignition; however, the circulation unit may be formed of an arbitrary means, as long as the primary winding L1 can be short-circuited; for example, the primary winding L1 may be short-circuited by use of an arbitrary switching device such as a thyristor or a transistor.

For the sake of explanation, the constant-current limiting unit 23 in the circulation current control unit 21 consists of the fourth switch SW4 and a variable resistor 24 so as to become simple; however, this is the most simple configuration example for the sake of explanation; because it is only necessary that the electric current flowing in the primary winding L1 can be controlled to become equal to a current value commanded by ECU 22, the configuration of the constant-current limiting unit 23 is not limited to the foregoing configuration.

For example, by combining a great number of sets of a resistor device and a switching device, by use of a variable resistor or the like, or by controlling the base current of a transistor, the electric current can precisely be controlled. As the resistor device 18 for dissipating the magnetic flux, an arbitrary load device such as a variable resistor can be utilized.

When each of the driving signal S1 for the first switch SW1, the driving signal S2 for the second switch SW2, and the driving signal S4 for the fourth switch SW4 from ECU 22 is "Hi"-level, the corresponding switch is turned on so as to be conductive. In this situation, as each of the switches, an arbitrary switching means such as an IGBT or a transistor can be utilized.

When a current limiting signal S5 provided from ECU 22 to the constant-current limiting unit 23 is "Low"-level, the electric current in the closed circuit is not limited; when the current limiting signal S5 is "Hi"-level, the electric current value of the closed circuit is controlled so as to become equal to a current value designated by ECU 22.

In Embodiment 3, in the configuration of the current detection device, a current detection resistor and a differential amplifier are utilized; however, as the current detection means, an arbitrary method such as a current transformer may be utilized. The current detection device may be provided at an arbitrary position, as long as the electric current in the primary winding L1 can be detected; for example, the current detection device may be disposed between the primary winding L1 and the second switch SW2 for controlling ignition.

Thus, in the case where a spark discharge is caused to occur in the gap between the first electrode 13*a* and the second electrode 13*b* of the ignition plug 13, after the level of the driving signal S1 for the first switch SW1, which is an energizing switch for a spark discharge, is turned from "Low" to "Hi", the level of the driving signal S2 for the second switch SW2 is turned from "Low" to "Hi", so that energization of the primary winding L1 of the ignition winding 14 is started; after energization for a spark discharge is sufficiently implemented, the level of the driving signal S2 for the second switch SW2 is turned from "Hi" to "Low", so that an ignition high voltage is generated across the secondary winding L2 of the ignition winding 14; the ignition high voltage is applied to the ignition plug 13, so that a spark discharge occurs in the gap between the first electrode 13*a* and the second electrode 13*b* of the ignition plug 13.

Next, in the case where the level of the driving signal S1 for the first switch SW1 is "low", the level of the driving signal S2 for the second switch SW2 is "Hi", and the level of the driving signal S4 for the fourth switch SW4 is "Hi", the primary winding L1 of the ignition winding 14 and the constant-current limiting unit 23 form a closed circuit. In this situation, when the current limiting signal S5 is "Low"-level, the electric current in the closed circuit is not limited; when the current limiting signal S5 is "Hi"-level, the electric current value of the closed circuit is controlled by the constant-current limiting unit 23 so as to become equal to a current value designated by ECU 22. For the sake of simplicity of the explanation, a current value instruction means provided from ECU 22 to the circulation current control unit 21 is omitted; the electric current value is instructed by an arbitrary instruction means such as a pulse signal or a signal voltage value.

Next, in the case where the level of the driving signal S1 for the first switch SW1 is "low", the level of the driving signal S2 for the second switch SW2 is "Hi", and the level of the driving signal S4 for the fourth switch SW4 is "low", the primary winding L1 of the ignition winding 14 is short-circuited by the diode 15 and hence a closed circuit including the primary winding L1, the diode 15, and the resistor device 18 is formed. In this situation, the diode 15 permits the electric current that flows in the primary winding L1 to flow only in a direction the same as the direction in which the electric current flows when energization for a spark discharge is implemented.

FIG. 9 is a timing chart representing the operation of the internal-combustion-engine combustion state detecting apparatus according to Embodiment 3 of the present invention; A, B, C, D, E, F, G, and H represent the waveform of the driving signal S1, the waveform of the driving signal S2, the waveform of the driving signal S4, the waveform of the current limiting signal S5, the waveform of the primary current I1, the waveform of the central-electrode potential Vp of the ignition plug, the waveform of the secondary current I2 of the ignition winding, and the waveform of the ion current Iion detected by the ion current detection circuit, respectively.

In FIG. 9, at a time point t50, after the level of the driving signal S1 for the first switch SW1 is turned from "Low" to "Hi", the level of the driving signal S2 for the second switch SW2 is turned from "Low" to "Hi" at a time point t51, so that the primary current I1 flows in the primary winding L1 of the ignition winding 14; after that, at a time point t52 when a preliminarily set energization duration has elapsed, the levels of the driving signal S1 and the driving signal S2 are changed from "Hi" to "Low", so that the primary current I1 in the primary winding L1 of the ignition winding 14 is interrupted. as a result, a negative ignition high voltage is applied to the first electrode 13*a*, which is the central electrode of the ignition plug 13, and hence the central-electrode potential Vp steeply falls; thus, a spark discharge occurs in the gap between the first electrode 13*a* and the second electrode 13*b* of the ignition plug 13.

After a spark discharge occurs in the gap between the first electrode 13*a* and the second electrode 13*b* of the ignition plug 13, the level of the driving signal S4 for the fourth switch SW4 is changed from "Low" to "Hi" at a time point t53. Then, at a time point t54 when a spark discharging sustaining time, calculated based on the operation state of the internal combustion engine, has elapsed, the level of the driving signal S2 for the second switch SW2 is changed from "Low" to "Hi" again, so that the electric current starts to flow again in the primary winding L1 through the constant-current limiting unit 23. Then, when at a time point t55, the primary current I1, which has started to flow again, reaches a current value at which a magnetic field corresponding to the magnetic flux left in the iron core of the ignition winding 14 is generated, a voltage having a polarity that is opposite to the polarity of the ignition high voltage that is generated when a spark discharge occurs is induced across the secondary winding L2; thus, when the voltage between the first electrode 13*a* and the second electrode 13*b* becomes lower than the discharge maintaining voltage, the spark discharge in the ignition plug 13 is forcibly interrupted.

The current value of the circulation steeply rises until the time point t55 when a magnetic field H corresponding to magnetic flux Φ left in the ignition winding 14 is generated and hence the spark discharge in the ignition plug 13 is interrupted; however, because after the time point t55 when the spark discharge is interrupted, the magnetic flux Φ is further accumulated in the iron core of the ignition winding 14, the rising speed of the re-energization current is decelerated after the time point t55. The time point t55 when the interruption of discharge is completed is detected by detecting the current changing amount. For example, when a current changing amount is obtained and after the start of re-energization, the current changing amount becomes smaller than a predetermined threshold value at a certain time point, it is determined that the time point t55 when the interruption of discharge is completed has passed and then charging of the winding has been resumed. It is assumed that at a time point t56, the determination is completed. The current value of the circulation, to be utilized in the processing, is obtained in such a way that an output V1, obtained through amplification of a voltage drop across the current detection resistor 26 by the differential amplifier 27, is measured and then converted into a current value by ECU 22.

Provided that through a preliminary discharge-interruption experiment, there have been obtained a current changing amount of 30 [A/ms] in a period from the start of discharge interruption to the completion of the discharge interruption and a current changing amount of 2 [A/ms] at a time when after the completion of the discharge interruption, the magnetic flux is accumulated in the winding, the threshold value is set within a range from 2 [A/ms] to 30 [A/ms]. It is only necessary to set a low threshold value, so that complete discharge interruption is secured. For example, the threshold value is set to 10 [A/ms] or smaller.

When at the time point t56, the level of the current limiting signal S5 is changed from "Low" to "Hi", the constant-current limiting unit 23 starts to limit the electric current. At this time, the instruction current value provided from ECU to the constant-current limiting unit 23 is the current value that has been detected by the current detection device 25 at the time point t56.

At the time point t56, a constant primary current I1 starts to flow in the closed circuit that consists of the constant-current limiting unit 23 and the power source apparatus 12 at the primary winding L1 side of the ignition winding 14. Because the change in the electric current is made to zero during the interruption of discharge, no voltage to be caused by the interruption of discharge is generated across the secondary winding L2; therefore, because the interruption of discharge provides no effect to the ion-detection bias voltage, a stable voltage from the capacitor 20 is applied between the electrodes of the ignition plug 13.

At a time point t57 when the period from the time point t56 to the time point t57, which is the ion current detection period, ends, the level of the driving signal S4 for the fourth switch SW4 is changed from "Hi" to "Low", so that the closed circuit formed of the primary winding L1 and the constant-current limiting unit 23 is opened. After that, the primary winding L1 of the ignition winding 14 is short-circuited by the diode 15, so that a closed circuit that includes the primary winding L1, the diode 15, and the resistor device 18 and has a large resistance component is formed.

As a result, it is made possible to accelerate the speed of the magnetic-flux dissipation in the ignition winding 14 and hence it is made possible to prevent wasteful heat generation in the ignition winding 14 and to prevent the discharge-interruption cycle from being prolonged. Because the change in the value of the electric current that flows in the primary winding L1 becomes large, the level of the voltage generated across the secondary winding L2 while the discharge is interrupted becomes high; however, because the dielectric re-breakdown voltage is overwhelmingly higher (several [kV] to several ten [V]) than the foregoing voltage (several hundred [kV]) generated across the secondary winding L2, the spark discharge between the electrodes of the ignition plug does not occur again. For example, in order to accelerate the speed of the magnetic-flux dissipation while preventing the dielectric re-breakdown from occurring again, it is advisable that the resistance component of the closed circuit is adjusted to be approximately 0.1 [Ω] to 10 [Ω].

The time point t57 can arbitrarily be determined; however, in order to suppress the heat generation in the ignition winding 14 to a minimum, it is advisable that the time point t57 is calculated each time the operation state of the internal combustion engine changes, that a map is created, or that the time point t57 is calculated based on the result of ion current detection. For example, in the case where the determination on the in-cylinder combustion state, based on the ion current, is completed before the ion current detection period, which has preliminarily been set based on the operation state of the internal combustion engine or the map, ends, the time point t57 may be set to the determination ending time.

When at a time point t58, the level of the driving signal S2 for the second switch SW2 is changed from "Hi" to "Low", the closed circuit formed of the primary winding L1, the diode 15, and the resistor device 18 is opened and hence the discharge interruption operation in one combustion cycle of the internal combustion engine ends. In Embodiment 3, the power source apparatus 12 is commonly utilized as the power source for the circulation current control unit 21 and as the power source for making the primary current flow in order to cause a spark discharge to occur in the ignition plug 13; however, respective separate power source apparatuses therefor may be utilized without commonly utilizing the power source apparatus 12.

As described above, no change in the electric current flowing in the primary winding L1 occurs in the period from the time point t56 to the time point t57, which is the ion current detection period; thus, no voltage is generated across the secondary winding L2 and hence the discharge interruption provides no effect to the ion-detection bias voltage. Accordingly, as is the case with the conventional ion current detection apparatus, a stable ion-detection bias voltage from the capacitor 20 is applied between the first and second electrodes 13*a* and 13*b* of the ignition plug 13. As described above, it is not necessary that in order to surpass the voltage that is generated while the discharge is interrupted and has a polarity the same as that of the ignition high voltage, the charging voltage of the capacitor for generating the bias voltage is raised by approximately several hundred [V]; therefore, even during interruption of the discharge, it is made possible to perform stable and high-accuracy ion current detection by use of a capacitor charging voltage that is as high as the conventional one.

When the period from the time point t55 to the time point t56, which is the period in which the discharge is interrupted and then the completion of the discharge interruption is detected, is shortened as much as possible, the current-value rise after the interruption of the discharge is suppressed to be small and hence wasteful heat generation in the primary winding L1 can be suppressed. Because only in the ion current detection period, the control is performed in such a way that the electric current flowing in the primary winding L1 during the interruption of discharge is constant, the prolongation of the period required for one cycle of the discharge interruption can be suppressed to a minimum; therefore, high-speed rotation of the internal combustion engine can also be dealt with.

Next, with regard to the operation of the internal-combustion-engine combustion state detecting apparatus according to Embodiment 3, an example of processing performed by ECU 22 will be explained in detail by use of a flowchart. A set of FIGS. 10A and 10B is a flowchart representing the processing implemented by the electronic control unit in the internal-combustion-engine combustion state detecting apparatus according to Embodiment 3 of the present invention.

In FIGS. 10A and 10B, ECU 22 is to comprehensively control the spark discharging occurrence timing, the fuel injection amount, the idling rotation speed, and the like of the internal combustion engine; for the purpose of performing ignition control processing, explained later, ECU 22 separately performs operation state detection processing for detecting the operation states of the units of the internal combustion engine, such as the intake air amount (intake pipe pressure), the rotation speed, the throttle opening degree, the coolant temperature, the intake air temperature, and the like of the internal combustion engine.

At first, in ST300, reading of the operation state is started; in ST301, the spark discharge occurrence time and the spark discharge maintaining time are set based on the read operation state.

Next, in the ST302, based on the spark discharge occurrence time, the spark discharge maintaining time, and the operation state of the internal combustion engine, there are set the initial energization period (the "Hi"-level period of the driving signal S1) of the primary winding L1 for a spark discharge in the ignition plug 13, the circulation period (the "Hi"-level period of the driving signal S2) of the primary current in the primary winding L1 at a time when the primary winding L1 is short-circuited so that the circulation occurs, and the ion current detection period (the "Hi"-level period of the driving signal S4). The initial value of each of the driving signals S1, S2, and S4 is "Low"-level.

In ST303, based on the set initial energization period of the primary current, it is determined whether or not the initial energization period starting timing has been reached; in the case where the initial energization period starting timing has not been reached (No), ST303 is repeated until it is determined that the initial energization period starting timing has been reached. In the case where it is determined that the initial energization period starting timing has been reached (Yes), ST303 is followed by ST304.

In ST304, the level of the driving signal S1 is changed from "Low" to "Hi"; then, in ST305, the level of the driving signal S2 is changed from "Low" to "Hi". As a result, energization of the primary winding L1 of the ignition winding 14 is started.

Next, in ST306, it is determined whether or not the initial energization period for the primary winding L1 of the ignition winding 14 has reached a preliminarily set time; in the case where the initial energization period for the primary winding L1 of the ignition winding 14 has not reached the preliminarily set time (No), ST306 is repeated until it is determined that the initial energization period for the primary winding L1 of the ignition winding 14 has reached the preliminarily set time. In the case where it is determined that the initial energization period for the primary winding L1 of the ignition winding 14 has reached the preliminarily set time (Yes), ST306 is followed by ST307.

In ST307, the level of each of the driving signals S1 and S2 is changed from "Hi" to "Low". As a result, the primary current I1 flowing in the primary winding L1 of the ignition winding 14 is interrupted; an ignition high voltage is generated across the secondary winding L2 of the ignition winding 14; then, a spark discharge is produced between the first electrode 13*a* and the second electrode 13*b* of the ignition plug 13.

After the spark discharge in ST307, the level of the driving signal S4 is changed from "Low" to "Hi" in ST308, so that there is made preparations for short-circuiting the primary winding L1 of the ignition winding 14 in order to interrupt the discharge. In this situation, because the driving signal S2 is "Low"-level, the primary winding L1 of the ignition winding 14 is not short-circuited.

Next, in ST309, it is determined whether or not a preliminarily set primary winding circulation period starting timing has been reached; in the case where it is determined that the preliminarily set primary winding circulation period starting timing has not been reached (No), ST309 is repeated until it is determined that the preliminarily set primary winding circulation period starting timing has been reached; in the case where it is determined that the preliminarily set primary winding circulation period starting timing has been reached (Yes), ST309 is followed by ST310.

In ST310, when the level of the driving signal S2 is changed from "Low" to "Hi", an electric current starts to flow in the circuit including the primary winding L1 of the ignition winding 14, the power source apparatus 12, and the constant-current limiting unit 23. In this situation, because the current limiting signal S5 is "Low"-level, the electric current flows without being limited.

Next, in ST311, the voltage outputted from the current detection device 25 is converted into a current value in ECU 22; then, the primary winding current information is read.

Next, in ST312, the current information on the primary winding L1 is processed; then, it is determined whether or not the obtained current changing amount has become a predetermined threshold value or smaller. In the case where it is determined that the obtained current changing amount has not become the predetermined threshold value or smaller (No), ST312 is followed by ST311; in the case where it is determined that the obtained current changing amount has become the predetermined threshold value or smaller (Yes), it is regarded that the spark discharge interruption has been completed and then, ST312 is followed by ST313.

Next, in ST313, the current value at a time when the spark discharge interruption is completed is set to a target current value of the constant-current limiting unit 23 and the level of the current limiting signal S5 is changed from "Low" to "Hi", so that the electric current flowing the primary winding L1 is limited so as to be constant.

Next, in ST314, reading of the ion current information detected by the ion current detection circuit 11 is started.

Next, in ST315, it is determined whether or not a preliminarily set ion current detection period ending time has been reached; in the case where it is determined that the preliminarily set ion current detection period ending time has not been reached (No), ST315 is followed by ST316; in the case where it is determined that the preliminarily set ion current detection period ending time has been reached (Yes), ST315 is followed by ST317.

In ST316, based on the ion current detection information, it is determined whether or not ECU 22 has completed its combustion state determination; in the case where it is determined that ECU 22 has not completed its combustion state determination (No), ST315 is resumed. In the case where it is determined that ECU 22 has completed its combustion state determination (Yes), ST316 is followed by ST317 before the preliminarily set ion current detection period ends.

In ST317, the reading of the ion current detection information is ended; then, in ST318, the levels of the driving signal S4 and the current limiting signal S5 are changed from "Hi" to "Low", so that due to the circulation in the closed circuit having a large resistance component, the magnetic energy left in the ignition winding 14 is actively dissipated.

Next, in ST319, it is determined whether or not a preliminarily set primary winding circulation period ending time has been reached; in the case where it is determined that the preliminarily set primary winding circulation period ending time has not been reached (No), ST319 is repeated. In the case where it is determined that the preliminarily set primary winding circulation period ending time has been reached (Yes), ST319 is followed by ST320.

In ST320, the level of the driving signal S2 is changed from "Hi" to "Low" and hence the short-circuit path for the primary winding L1 is opened; then, the ion current detection processing performed by ECU 22 is completed.

Because as described above, only in the ion current detection period, the control is performed in such a way that the change in the value of the electric current flowing in the primary winding L1 becomes small or in such a way that the current value is constant, the time of superfluous energization of the primary winding L1 is shortened as much as possible and hence wasteful heat generation in the ignition winding 14 can be suppressed. In Embodiment 3, the primary winding circulation period ending time has preliminarily been set based on the operation state of the internal combustion engine; however, the primary winding circulation period ending time may be determined in real time by use of a current value obtained from the current detection device.

Embodiment 4

Next, an internal-combustion-engine combustion state detecting apparatus according to Embodiment 4 of the present invention will be described. In foregoing Embodiment 3, because even after the discharge ends, the current value rises, the current value during the ion current detection period considerably increases in comparison with the current value required for interrupting the discharge. Accordingly, in Embodiment 4, the internal-combustion-engine combustion state detecting apparatus is configured in such a way that the current value during the ion current detection period does not become the same as or larger than the current value required for interrupting the discharge.

As described above, FIG. 8 is an example of basic configuration of the internal-combustion-engine combustion state detecting apparatus according to any one of Embodiments 3 and 4; because the configuration of the internal-combustion-engine combustion state detecting apparatus according to Embodiment 4 is the same as that of the internal-combustion-engine combustion state detecting apparatus according to foregoing Embodiment 3, the explanation for the configuration will be omitted. In Embodiment 4, a single-cylinder internal combustion engine will be explained; however, the present invention can be applied also to a multi-cylinder internal combustion engine. In that case, ion current detection apparatuses having the same basic configuration may be provided for the respective cylinders or the two or more cylinders may share a partial configuration element of the combustion state detecting apparatus, such as a circulation current control unit.

FIG. 11 is a timing chart representing the operation of the internal-combustion-engine combustion state detecting apparatus according to Embodiment 4 of the present invention; A, B, C, D, E, F, G, and H represent the waveform of the driving signal S1, the waveform of the driving signal S2, the waveform of the driving signal S4, the waveform of the current limiting signal S5, the waveform of the primary current I1, the waveform of the central-electrode potential Vp of the ignition plug, the waveform of the secondary current I2 of the ignition winding, and the waveform of the ion current Iion detected by the ion current detection circuit, respectively.

In FIG. 11, at a time point t60, after the level of the driving signal S1 for the first switch SW1 is changed from "Low" to "Hi", the level of the driving signal S2 for the second switch SW2 is changed from "Low" to "Hi" at a time point t61, so that the primary current I1 flows in the primary winding L1 of the ignition winding 14. After that, at a time point t62 when a preliminarily set energization duration has elapsed, the levels of the driving signal S1 and the driving signal S2 are changed from "Hi" to "Low", so that the primary current I1 in the primary winding L1 of the ignition winding 14 is interrupted; as a result, a negative ignition high voltage is applied to the first electrode 13*a*, as the central electrode of the ignition plug 13, and hence the central-electrode potential Vp steeply falls; thus, a spark discharge occurs in the gap between the first electrode 13*a* and the second electrode 13*b* of the ignition plug 13.

Then, after the spark discharge occurs in the gap between the first electrode 13*a* and the second electrode 13*b* of the ignition plug 13, the level of the driving signal S4 for the fourth switch SW4 is "Low" at a time point t63; then, at a time point t64 when a spark discharging sustaining time, calculated based on the operation state of the internal combustion engine, has elapsed, the level of the driving signal S2 for the second switch SW2 is changed from "Low" to "Hi" again, so that the primary winding L1 is short-circuited and hence the circulation current starts to flow again.

When at a time point t65, the primary current I1, which has started to flow again, reaches a current value at which a magnetic field corresponding to the magnetic flux left in the iron core of the ignition winding 14 is generated, a voltage having a polarity that is opposite to the polarity of the ignition high voltage that has been generated in the secondary winding L2 during spark discharging is induced across the secondary winding L2. Then, when the voltage between the first electrode 13*a* and the second electrode 13*b* becomes lower than the discharge maintaining voltage, the spark discharge in the ignition plug 13 is forcibly interrupted.

Until the time point t65 when a magnetic field H corresponding to magnetic flux Φ left in the ignition winding 14 is generated and hence the spark discharge in the ignition plug 13 is interrupted, the current value of the circulation steeply rises; however, because after the time point t65 when the spark discharge is interrupted, the magnetic flux in the ignition winding 14 is dissipated, the current value gradually decreases. The time point t65 when the interruption of discharge is completed is detected by detecting the peak of the circulation current.

For example, it is only necessary that peak-hold processing is applied to the current value of the circulation and it is determined that the discharge stopping time has been reached, as long as the peak value is not updated even when a preliminarily set discharge stopping determination time has elapsed; t66 is specified as the time when the determination ends. The current value of the circulation, to be utilized in the processing, is obtained in such a way that an output V1, obtained through amplification of a voltage drop across the current detection resistor 26 by the differential amplifier 27, is measured and then converted into a current value by ECU 22.

In the period from the time point t65 to the time point t66, which is the period from a time when the discharge stopping is completed to a time when the detection of discharge interruption is completed, the electric current decreases; therefore, a voltage having a polarity the same as that of the spark discharging voltage is generated across the secondary winding L2. Accordingly, the ion-current detection bias voltage decreases in this period; thus, the ion-current detection performance is deteriorated or detection of the ion current cannot be performed. Therefore, it is advisable that the discharge stopping determination time is shortened to the extent that noise superimposed on the current detection value, for example, does not cause the time point t65 when the discharge ends to be erroneously detected so that the period from the time point t65 to the time point t66 is shortened as much as possible.

When at the time point t66, the level of the current limiting signal S5 is changed from "Low" to "Hi", the constant-current limiting unit 23 starts to limit the electric current. At this time, the instruction current value provided from ECU 22 to the constant-current limiting unit 23 is the current value that has been detected by the current detection device 25 at the time point t66.

At the time point t66, a constant primary current I1 starts to flow in the closed circuit that consists of the constant-current limiting unit 23 and the power source apparatus 12 at the primary winding L1 side of the ignition winding 14. Because the change in the electric current is made to zero during the interruption of discharge, no voltage to be caused by the interruption of discharge is generated across the secondary winding L2; therefore, because the interruption of discharge provides no effect to the ion-detection bias voltage, a stable voltage from the capacitor 20 is applied between the first electrode 13*a* and the second electrode 13*b* of the ignition plug 13.

At a time point t67 when the period from the time point t66 to the time point t67, which is the ion current detection period, ends, the level of the driving signal S4 for the fourth switch SW4 is changed from "Hi" to "Low", so that the closed circuit formed of the primary winding L1 and the constant-current limiting unit 23 is opened. After that, the primary winding L1 of the ignition winding 14 is short-circuited by the diode 15, so that a closed circuit that includes the primary winding L1, the diode 15, and the resistor device 18 and has a large resistance component is formed.

As a result, it is made possible to accelerate the speed of the magnetic-flux dissipation in the ignition winding 14 and hence it is made possible to prevent wasteful heat generation in the winding and to prevent the discharge-interruption cycle from being prolonged. Because the change in the value of the electric current that flows in the primary winding L1 becomes large, the level of the voltage generated across the secondary winding L2 while the discharge is interrupted becomes high; however, because the dielectric re-breakdown voltage is overwhelmingly higher (several [kV] to several ten [kV]) than the foregoing voltage (several hundred [V]) generated across the secondary winding L2, the spark discharge between the electrodes of the ignition plug does not occur again. For example, in order to accelerate the speed of the magnetic-flux dissipation while preventing the dielectric re-breakdown from occurring, it is advisable that the resistance component of the closed circuit is adjusted to be approximately 0.1 [Ω] to 10 [Ω].

The time point t67 can arbitrarily be determined; however, in order to suppress the heat generation in the ignition winding 14 to a minimum, it is advisable that the time point t67 is calculated each time the operation state of the internal combustion engine changes, that a map is created, or that the time point t67 is calculated based on the result of ion current detection. For example, in the case where the determination on the in-cylinder combustion state, based on the ion current, is completed before the ion current detection period, which has preliminarily been set based on the operation state of the internal combustion engine or the map, ends, the time point t67 may be set to the determination ending time.

When at a time point t68, the level of the driving signal S2 for the second switch SW2 is changed from "Hi" to "Low", the closed circuit formed of the primary winding L1, the diode 15, and the resistor device 18 is opened and hence the discharge interruption operation in one combustion cycle of the internal combustion engine ends. In Embodiment 4, the power source apparatus 12 is commonly utilized as the power source for the circulation current control unit 21 and as the power source for making the primary current flow in order to cause a spark discharge to occur in the ignition plug 13; however, respective separate power sources therefor may be utilized without commonly utilizing the power source apparatus 12.

As described above, no change in the electric current flowing in the primary winding L1 occurs in the period from the time point t66 to the time point t67, which is the ion current detection period; thus, no voltage is generated across the secondary winding L2 and hence the discharge interruption provides no effect to the ion-detection bias voltage. Accordingly, as is the case with the conventional ion current detection apparatus, a stable ion-detection bias voltage from the capacitor 20 is applied between the electrodes of the ignition plug 13. As described above, it is not necessary that in order to surpass the voltage that is generated while the discharge is interrupted and has a polarity the same as that of the ignition high voltage, the charging voltage of the capacitor 20 for generating the bias voltage is raised by approximately several hundred [V]; therefore, even during interruption of the discharge, it is made possible to perform stable and high-accuracy ion current detection by use of a capacitor charging voltage that is as high as the conventional one.

The period from the time point t66 to the time point t67, which is the period in which the discharge is interrupted and then the completion of the discharge interruption is detected, is shortened as much as possible, so that wasteful heat generation in the primary winding L1 can be suppressed; only in the ion current detection period, the control is performed in such a way that the electric current flowing in the primary winding L1 during discharge interruption becomes constant, so that the prolongation of the period required for one cycle of the discharge interruption can be suppressed to a minimum and hence high-speed rotation of the internal combustion engine can also be dealt with.

Next, with regard to the operation of the internal-combustion-engine combustion state detecting apparatus according to Embodiment 4, an example of processing performed by ECU 22 will be explained in detail by use of a flowchart. A set of FIGS. 12A and 12B is a flowchart representing the processing implemented by the electronic control unit in the internal-combustion-engine combustion state detecting apparatus according to Embodiment 4 of the present invention. ECU 22 is to comprehensively control the spark discharging occurrence timing, the fuel injection amount, the idling rotation speed, and the like of the internal combustion engine; for the purpose of performing ignition control processing, explained later, ECU 22 separately performs operation state detection processing for detecting the operation states of the units of the internal combustion engine, such as the intake air amount (intake pipe pressure), the rotation speed, the throttle opening degree, the coolant temperature, the intake air temperature, and the like of the internal combustion engine.

In FIGS. 12A and 12B, at first, in ST400, reading of the operation state of the internal combustion engine is started; in ST401, the spark discharge occurrence time and the spark discharge maintaining time are set based on the read operation state.

Next, in the ST402, based on the spark discharge occurrence time, the spark discharge maintaining time, and the operation state of the internal combustion engine, there are set the initial energization period (the "Hi"-level period of the driving signal S1) of the primary winding L1 for a spark discharge in the ignition plug 13, the primary winding circulation period (the "Hi"-level period of the driving signal S2) in which the primary winding L1 is short-circuited so that the circulation occurs, and the ion current detection period (the "Hi"-level period of the driving signal S4). The initial value of each of the driving signals S1, S2, and S4 is "Low"-level.

In ST403, based on the set initial energization period of the primary current, it is determined whether or not the initial energization period starting timing has been reached; in the case where the initial energization period starting timing has not been reached (No), ST403 is repeated until it is determined that the initial energization period starting timing has been reached. In the case where it is determined that the initial energization period starting timing has been reached (Yes), ST403 is followed by ST404.

In ST404, the level of the driving signal S1 is changed from "Low" to "Hi"; then, in ST405, the level of the driving signal S2 is changed from "Low" to "Hi". As a result, energization of the primary winding L1 of the ignition winding 14 is started.

Next, in ST406, it is determined whether or not the initial energization period for the primary winding L1 of the ignition winding 14 has reached a preliminarily set time; in the case where the initial energization period for the primary winding L1 of the ignition winding 14 has not reached the preliminarily set time (No), ST406 is repeated until it is determined that the initial energization period for the primary winding L1 of the ignition winding 14 has reached the preliminarily set time. In the case where it is determined that the initial energization period for the primary winding L1 of the ignition winding 14 has reached the preliminarily set time (Yes), ST406 is followed by ST407.

In ST407, the level of each of the driving signals S1 and S2 is changed from "Hi" to "Low". As a result, the primary current I1 flowing in the primary winding L1 of the ignition winding 14 is interrupted; an ignition high voltage is generated across the secondary winding L2 of the ignition winding 14; then, a spark discharge is produced between the first electrode 13*a* and the second electrode 13*b* of the ignition plug 13.

Next, in ST408, it is determined whether or not a preliminarily set primary winding circulation period starting timing has been reached; in the case where it is determined that the preliminarily set primary winding circulation period starting timing has not been reached (No), ST408 is repeated until it is determined that the preliminarily set primary winding circulation period starting timing has been reached; in the case where it is determined that the preliminarily set primary winding circulation period starting timing has been reached (Yes), ST408 is followed by ST409.

In ST409, the level of the driving signal S2 is changed from "Low" to "Hi" and hence the primary winding L1 of the ignition winding 14 is short-circuited; then, an electric current starts to flow in the primary winding L1.

Next, in ST410, the voltage outputted from the current detection device 25 is converted into a current value in ECU 22; then, current information on the primary winding L1 is read.

In ST411, in ECU 22, peak-hold processing is applied to the read current value of the primary winding L1; then, the maximum value is stored.

Next, in ST412, it is determined whether or not the immediately previous current value is not replaced by the maximum current value, which has been referred to this time, and a predetermined time has elapsed; in the case where it is determined that the predetermined time has not elapsed (No), ST412 is followed by ST410; in the case where it is determined that the predetermined time has elapsed (Yes), it is regarded that the spark discharge interruption has been completed and then, ST412 is followed by ST413.

In ST413, the current value at a time when the spark discharge interruption is completed is set to a target current value of the constant-current limiting unit 23 and the levels of the driving signal S4 and the current limiting signal S5 are changed from "Low" to "Hi", so that the value of the electric current flowing in the primary winding L1 is limited so as to be constant.

In ST414, reading of the ion current information detected by the ion current detection circuit 11 is started.

Next, in ST415, it is determined whether or not a preliminarily set ion current detection period ending time has been reached; in the case where it is determined that the preliminarily set ion current detection period ending time has not been reached (No), ST415 is followed by ST416; in the case where it is determined that the preliminarily set ion current detection period ending time has been reached (Yes), ST415 is followed by ST417.

In ST416, based on the ion current detection information, it is determined whether or not ECU 22 has completed its combustion state determination; in the case where it is determined that ECU 22 has not completed its combustion state determination (No), ST415 is resumed; in the case where it is determined that ECU 22 has completed its combustion state determination (Yes), ST416 is followed by ST417 before a preliminarily set ion current detection period ends.

In ST417, the reading of the ion current detection information is ended; then, in ST418, the levels of the driving signal S4 and the current limiting signal S5 are changed from "Hi" to "Low", so that due to the circulation in the closed circuit having a large resistance component, the magnetic energy left in the ignition winding 14 is actively dissipated.

Next, in ST419, it is determined whether or not a preliminarily set primary winding circulation period ending time has been reached; in the case where it is determined that the preliminarily set primary winding circulation period ending time has not been reached (No), ST419 is repeated; in the case where it is determined that the preliminarily set primary winding circulation period ending time has been reached (Yes), ST419 is followed by ST420.

In ST420, the level of the driving signal S2 is changed from "Hi" to "Low" and hence the short-circuit path for the primary winding L1 is opened; then, the ion current detection processing performed by ECU 22 is completed.

Because as described above, only in the ion current detection period, the control is performed in such a way that the change in the value of the electric current flowing in the primary winding L1 becomes small or in such a way that the current value is constant, the time of superfluous energization of the primary winding L1 is shortened as much as possible and hence wasteful heat generation in the ignition winding 14 can be suppressed. In Embodiment 4, the primary winding circulation period ending time has preliminarily been set based on the operation state of the internal combustion engine; however, the primary winding circulation period ending time may be determined in real time by use of a current value obtained from the current detection device.

After the ion current detection is completed, the circulation current control unit performs control in such a way that the decreasing speed of the electric current in the circulation is accelerated, so that wasteful heat generation in the primary winding L1 is suppressed and prolongation of the period required for one cycle of discharge interruption is suppressed to a minimum; thus, high-speed rotation of the internal combustion engine can also be dealt with.

The present invention is not limited to the internal-combustion-engine combustion state detecting apparatus according to any one of Embodiments 1 through 4; in the scope within the spirits of the present invention, the configurations of Embodiments 1 through 4 can appropriately be combined with one another, can partially be modified, or can partially be omitted.

What is claimed is:

1. An internal-combustion-engine combustion state detecting apparatus comprising:

a circulation unit;

a circulation current control unit;

an ignition winding including a primary winding and a secondary winding magnetically coupled with the primary winding;

a power source apparatus that supplies the primary winding with an electric current;

a switch that is disposed between the primary winding and the power source apparatus and controls energization and de-energization of the electric current; and an ion current detection apparatus that detects an ion current in a combustion chamber of an internal combustion engine, the ion current being generated by igniting, by a spark discharge produced by an ignition plug provided in the internal combustion engine, an inflammable fuel-air mixture provided in the combustion chamber;

wherein the ignition winding is configured so that when the switch is in a conduction state, the power source apparatus supplies the primary winding with an electric current that is accumulated in the primary winding as energy for producing the spark discharge, and so that when the switch is turned off while the power source apparatus is supplying the primary winding with the electric current, the electric current flowing in the primary winding is interrupted, generating a voltage in the secondary winding that causes the spark discharge in the ignition plug, wherein based on the ion current detected by the ion current detection apparatus, a combustion state of the inflammable fuel-air mixture is detected, and wherein the circulation unit is configured so that while the spark discharge is produced in the ignition plug, the primary winding is short-circuited and a circulation path including the primary winding is formed and the circulation current control unit is configured to control a circulation current flowing in the circulation path by adjusting the resistance component of the circulation path.

2. The internal-combustion-engine combustion state detecting apparatus according to claim 1, wherein the circulation current control unit controls the circulation current in a predetermined period so that the value of the circulation current becomes substantially constant in the predetermined period.

3. The internal-combustion-engine combustion state detecting apparatus according to claim 2, wherein the predetermined period is set so as to include the period in which the ion current detection apparatus detects the ion current.

4. The internal-combustion-engine combustion state detecting apparatus according to claim 2, wherein the predetermined period is set so as to end at a time point when detection of the combustion state ends based on the ion current detected by the ion current detection apparatus.

5. The internal-combustion-engine combustion state detecting apparatus according to claim 2, wherein the circulation current control unit controls the circulation current so that in a period other than the period in which the ion current detection apparatus detects the ion current, the circulation current decreases faster than in the predetermined period.

6. An internal-combustion-engine combustion state detecting apparatus comprising:

a circulation unit;

a circulation current control unit;

an ignition winding including a primary winding and a secondary winding magnetically coupled with the primary winding;

a power source apparatus that supplies the primary winding with an electric current;

a switch that is disposed between the primary winding and the power source apparatus and controls energization and de-energization of the electric current; and an ion current detection apparatus that detects an ion current in a combustion chamber of an internal combustion engine, the ion current being generated by igniting, by a spark discharge produced by an ignition plug provided in the internal combustion engine, an inflammable fuel-air mixture provided in the combustion chamber;

wherein the ignition winding is configured so that when the switch is in a conduction state, the power source apparatus supplies the primary winding with an electric current that is accumulated in the primary winding as energy for producing the spark discharge, and so that when the switch is turned off while the power source apparatus is supplying the primary winding with the electric current, the electric current flowing in the primary winding is interrupted, generating a voltage in the secondary winding that causes the spark discharge in the ignition plug, wherein based on the ion current detected by the ion current detection apparatus, a combustion state of the inflammable fuel-air mixture is detected, and wherein the circulation unit is configured so that while the spark discharge is produced in the ignition plug, the primary winding is short-circuited and a circulation path including the primary winding is formed and the circulation current control unit is configured to control a constant current circuit so that a circulation current flowing in the circulation path is substantially constant.

* * * * *